US008000490B2

(12) United States Patent
Yang

(10) Patent No.: US 8,000,490 B2
(45) **Date of Patent: *Aug. 16, 2011**

(54) EARPHONE STRUCTURE WITH A COMPOSITE SOUND FIELD

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 342 days.

This patent is subject to a terminal disclaimer.

(21) Appl. No.: 12/262,149

(22) Filed: Oct. 30, 2008

(65) Prior Publication Data

US 2009/0060248 A1 Mar. 5, 2009

Related U.S. Application Data

(62) Division of application No. 10/709,956, filed on Jun. 9, 2004, now Pat. No. 7,463,748.

(30) Foreign Application Priority Data

Mar. 22, 2004 (TW) ..... 93107621 A
Apr. 29, 2004 (TW) ..... 93111985 A

(51) Int. Cl.
*H04R 25/00* (2006.01)

(52) U.S. Cl. ..... 381/371; 381/309; 381/370

(58) Field of Classification Search ..... 381/300, 381/307, 376, 382, 309, 337, 338, 345, 351, 381/162, 74, 99, 370, 371; 379/430; 181/129
See application file for complete search history.

(56) References Cited

U.S. PATENT DOCUMENTS 7,155,025 B1 * 12/2006 Weffer ..... 381/370
7,289,641 B2 * 10/2007 Yang ..... 381/382
7,817,814 B2 * 10/2010 Yang ..... 381/371

FOREIGN PATENT DOCUMENTS

DE 2126677 8/1972
JP 62080492 4/1987
JP 01-314098 12/1989

OTHER PUBLICATIONS

"Office Action of German counterpart application", issued on Jul. 15, 2009, p. 1-p. 17.

* cited by examiner

*Primary Examiner* — Huyen D Le
(74) *Attorney, Agent, or Firm* — Jianq Chyun IP Office

(57) ABSTRACT

An earphone structure including one or more composite chambers is described. Each of the composite chambers includes sub-speakers. The sounds generated by these sub-speakers are uniformly distributed in the composite chamber and a composite sound field is generated by these sub-speakers. The sound field generated by each of these sub-speakers can be adjusted by re-locating the position of the sub-speaker, for example, by re-locating the sub-speaker, or by re-locating the sub-speaker in different angles, to generate the composite sound field. The sound field generated by the main speaker and the composite sound field generated by these sub-speakers can form a spatial sound with very good quality. By using of its physical characteristics of locations of these sub-speakers, the sound generated by the earphone has an uniformly diffusion sound pressure and a surround effect, which allows a user of the earphone to enjoy a sound field similar to that in a theater.

22 Claims, 22 Drawing Sheets

EARPHONE STRUCTURE WITH A COMPOSITE SOUND FIELD

CROSS-REFERENCE TO RELATED APPLICATION

This is a divisional application of patent application Ser. No. 10/709,956, filed on Jun. 9, 2004, which claims the priority benefit of Taiwan patent application serial no. 93107621, filed on Mar. 22, 2004 and Taiwan patent application serial no. 93111985, filed Apr. 29, 2004. The entirety of each of the above-mentioned patent applications is hereby incorporated by reference herein and made a part of this specification.

BACKGROUND OF THE INVENTION

1. Field of the Invention

The present invention relates to an earphone, and more particularly, to an earphone structure with a composite sound field.

2. Description of the Related Art

Along with the progress of the digital technology, people's entertainment also becomes digitalized. For example, the digital video disc (DVD) player is a commonly used video playing apparatus in family life nowadays. Since the DVD player basically supports Dolby Digital or Digital Theater System (DTS) decoding functions, it can decode the digital signal and provide the analog signal to speakers for sounding.

In order to have a high quality digital AV entertainment life, a multi-channel speaker is a mandatory device, and the 5.1 channel speakers are a base of the multi-channel speaker.

FIG. 1 is a schematic diagram of a home theater with 5.1 channel speakers. Referring to FIG. 1, when a DVD player 100 is playing an AV title, different sound signals are respectively provided to a left speaker 102*a* of the front main channel, a right speaker 102*b* of the front main channel, a center speaker 104, a left speaker 106*a* of the surround channel, a right speaker 106*b* of the surround channel, and a subwoofer speaker 108, so as to generate a 3D sound effect and to provide an environment for simulating a real theater effect.

However, an earphone is required for listening audio when it is not suitable to use the speaker (e.g. to prevent from disturbing others). Referring to FIG. 2A, since a general earphone 200*a* only has one speaker 210 at its left and right side portion respectively, it is not possible for a user to enjoy the multi-channel sound effect provided by the DVD player.

Therefore, an earphone with more speakers as shown in FIG. 2B is disclosed in the prior art. The earphone 200*b* comprises a front main speaker 202, a center speaker 204, and a surround speaker 206 at both sides of the earphone 200*b*. A special design plug 208 is also provided, such that the DVD player can provide the audio signal of different channel to different speaker via the plug 208 to generate the home theater sound effect by the 5.1 channel speakers as shown in FIG. 1. However, the conventional earphone 200*b* uses a digital design (e.g. digital circuit design) to control a delay time of the output audio signal, thus the sound field is rather poor. Comparing to the home theater sound effect of the 5.1 channel speakers as shown in FIG. 1, its sound effect is far behind and is too poor to express the quality and effect of the multi-channel surround sound.

An earphone with a plurality of internal speakers as shown in FIGS. 2C, 2D, and 2E is further disclosed in the prior art. It is a new invention for improving the earphone structure disclosed in ROC patent no. 534566. As shown in FIGS. 2C, 2D, and 2E, each of the channel speakers 21, 22, 23, and 24 inside the case 10 is isolated respectively by its individual room 11, 12, 13, and 15, so as to have its independent sound field. The independent sound field can prevent the sound generated by each of the channel speakers 21, 22, 23, and 24 from mixing up with the sound generated by other channel speakers. In addition, each of the channel speakers 21, 22, 23, and 24 can express the characteristic of its individual speaker via different angles. However, the conventional earphone structure in which each channel speaker having its individual room has its physical disadvantage. For example, since the sound generated by each channel speaker is limited in the individual room first, and then directly propagated to user's ear, a can-tone effect is generated accordingly. In other word, a noise similar to a tone propagated via a can is generated. The more of the channel speakers and their individual rooms, the more serious the can-tone effect. As a result, the quality of the multi-channel surround effect is undesirable, and the efficiency is not acceptable.

SUMMARY OF THE INVENTION

Accordingly, it is an object of the present invention to provide an earphone structure for improving the output sound quality, and for providing a saturated sound field and a multi-channel surround sound effect.

An earphone structure provided by the present invention comprises a case, a plurality of sub-speakers, a composite chamber, and a cover. The sub-speakers are installed on the composite chamber for forming a composite room, such that the sounds generated by the sub-speakers can form a composite sound field. The cover and the case jointly cover the composite chamber for forming the earphone structure.

An earphone structure provided by the present invention comprises a case, a main speaker, a plurality of sub-speakers, and a composite chamber. The main speaker and the sub-speakers are installed inside the case. The sub-speakers are installed on the composite chamber for forming a composite room, such that the sounds generated by the sub-speakers are distributed in the composite chamber and a composite sound field is generated. The cover and the case jointly cover the main speaker and the sub-speakers for forming the earphone structure. In addition, the sound field generated by each of these sub-speakers can be adjusted by re-locating the position of the sub-speaker according to its characteristic, for example, by re-locating the sub-speaker in a front side or a back side of the composite chamber, or by re-locating the sub-speaker in different angles, in order to generate the composite sound field. The sound field generated by the main speaker and the composite sound field generated by these sub-speakers in the composite chamber can form a spatial sound with very good quality. By using of the physical characteristics of the locations of these sub-speakers, the sound generated by the earphone has an uniform diffusion sound pressure and a surround effect, which may allow the user that uses the earphone to enjoy a sound field like that in a theater.

An earphone structure provided by the present invention further comprises a plurality of composite chambers, wherein, the main speaker and the sub-speakers are installed inside the case. The sub-speakers are distributed on the composite chambers based on the design in order to form a plurality of composite rooms, such that the sounds generated by the sub-speakers are distributed in the composite chambers and a plurality of composite sound fields is generated.

In accordance with an embodiment of the present invention, the sub-speakers comprise a first channel speaker and a second channel speaker, which are installed on two opposite sides of the composite chamber, respectively. In addition, in a preferred embodiment of the present invention, the first channel speaker is installed on a position which is asymmetrical to the position where the second channel speaker is installed.

In accordance with the embodiment of the present invention, the sub-speakers further comprise a subwoofer speaker, and the subwoofer speaker is preferably installed on a back side of the composite chamber which is opposite to the opening.

In accordance with the embodiment of the present invention, the composite chamber is constituted with a hollow column.

In accordance with the embodiment of the present invention, the room formed by the composite chamber is designed based on a specific physical structure, for example, the room may be formed by a grid plate.

In accordance with the embodiment of the present invention, wherein some of the sub-speakers further comprise a sub-room, and the sub-room is installed inside the composite chamber. In addition, each of the sub-rooms has an opening, and a gap is existed between the opening and the cover. In a preferred embodiment of the present invention, the gaps are not uniform.

In accordance with the embodiment of the present invention, the opening of some sub-rooms face to the cover.

In accordance with the embodiment of the present invention, the sub-rooms are for example constituted with a curve tube, wherein, the curve tube has a specific curve angle, and by using of its physical characteristics, the sound generated by the earphone has an uniform diffusion sound pressure and a surround effect.

The present invention provides an installation of a plurality of speakers on different positions inside the earphone based on its specific characteristic to generate a 3D sound effect. In addition, the present invention further uses a composite sound field to uniformly distribute the sounds generated by the speaker of different channels to balance the sound pressure.

In accordance with the embodiment of the present invention, the earphone structure mentioned above receives a signal which has been processed by a sound field simulation process, so as to generate a simulated sound field by the sub-speakers and the main speaker inside the composite chamber. In an embodiment of the present invention, the simulated sound field is designed based on a frequency-divided point of the sub-speakers and/or a delay circuitry, which is designed based on a delay process.

An earphone structure provided by the present invention comprises a composite chamber which is installed inside a case and a cover. The case and the cover jointly cover the composite chamber for forming the earphone structure. The composite chamber receives a plurality of sound source signals and forms a composite room where a composite sound field is formed from the sound source signals.

In the earphone structure mentioned above, at least one first sound source signal and one second sound source signal among the sound source signals are originated at two opposite sides of the composite chamber. In an embodiment of the present invention, the first sound source signal and the second sound source signal are asymmetrically disposed on two opposite sides of the composite chamber.

In the earphone structure mentioned above, the sound source signals at least comprise a subwoofer sound source signal. In an embodiment of the present invention, the subwoofer sound source signal is originated at a back side of the composite chamber.

In the earphone structure mentioned above, the sound source signals generate a simulated sound field in the composite chamber by using a sound field simulating process signal. In an embodiment of the present invention, the sound field simulating process is designed based on a frequency-divided point of the sound source signals and a delay process.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

An earphone structure provided by the present invention comprises a composite chamber which is installed inside a case and a cover. The case and the cover jointly cover the composite chamber for forming the earphone structure. The composite chamber receives a plurality of sound source signals or sound source entities and forms a composite room, such that a composite sound field is formed by the sound source signals or the sound source entities.

The sound source signals or sound source entities are originated at two opposite sides of the composite chamber, respectively. In an embodiment of the present invention, the sound source signals or sound source entities are asymmetrically disposed on two opposite sides of the composite chamber.

In addition, the sound source signals or the sound source entities generate a simulated sound field in the composite chamber by using a sound field simulating process signal. In an embodiment of the present invention, the simulated sound field is designed based on the frequency-divided point of the sound source signals or the sound source entities. In another embodiment of the present invention, the simulated sound field is designed based on the frequency-divided point of the sound source signals or the sound source entities or is designed based on a delay process.

In addition, the sound field generated by each of the sound source signals or the sound source entities can be adjusted by re-locating the position of the sound source signals or the sound source entities according to their characteristic, for example, by re-locating the sound source signals or the sound source entities to a front side or a back side of the composite chamber, or by re-locating the sound source signals or the sound source entities in different angles, in order to generate the composite sound field. The sound field generated by the main speaker and the composite sound field generated by the sound source signals or the sound source entities in the composite chamber can form a spatial sound with very good quality. By using of its physical characteristics of the positions of the sound source signals or the sound source entities, the sound wave generated by the earphone has an uniform diffusion sound pressure and a surround effect, which allow an user of the earphone to enjoy a sound field similar to that in a theater.

The preferred embodiments are exemplified hereinafter for explaining the present invention. To be noted that following embodiments are only used for the purpose to explain the present invention more easily and are not intended to limit the scope of the present invention.

Figure 1:
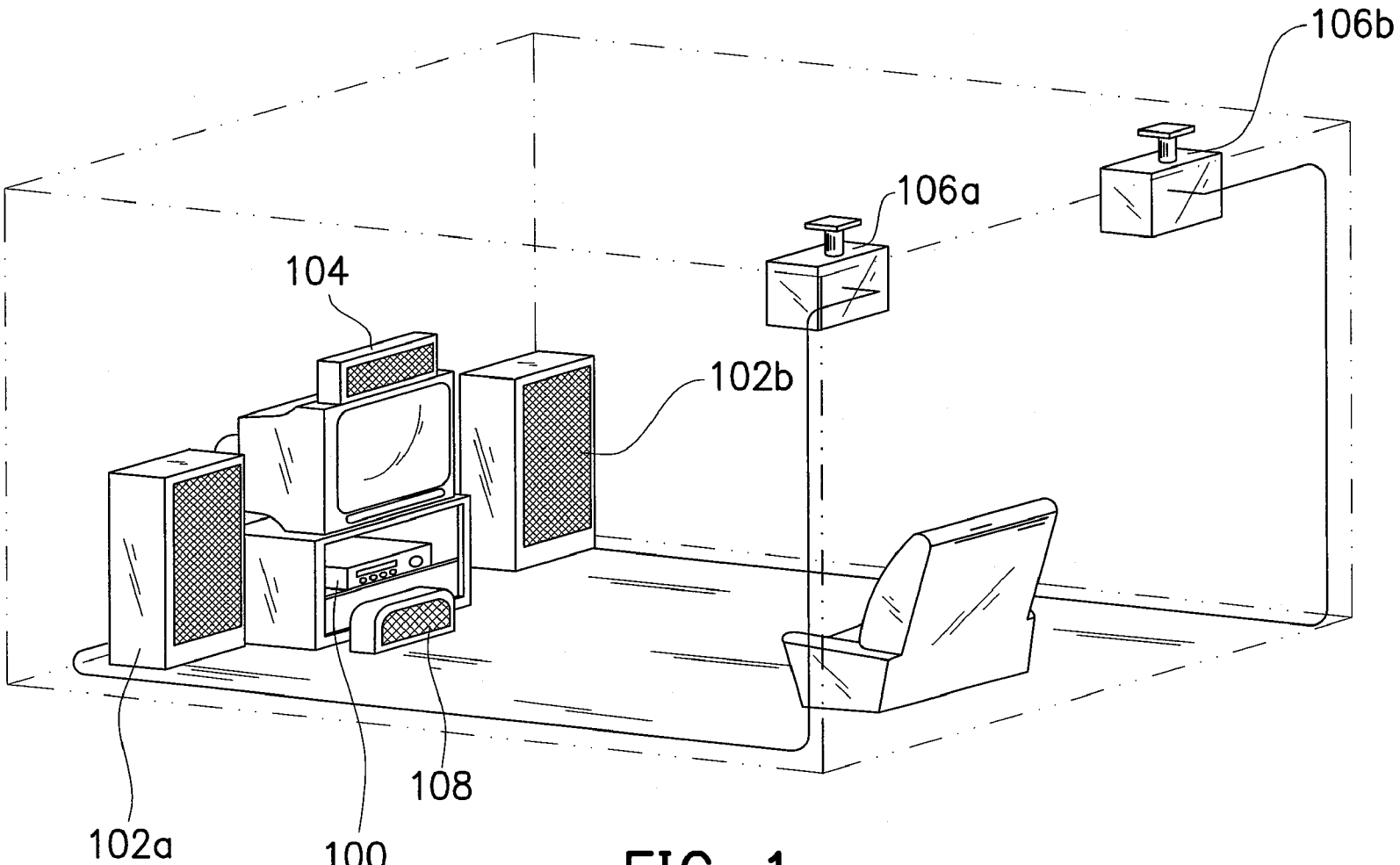
FIG. 1 is a schematic diagram of a home theater with 5.1 channel speakers.
Figure 2A:
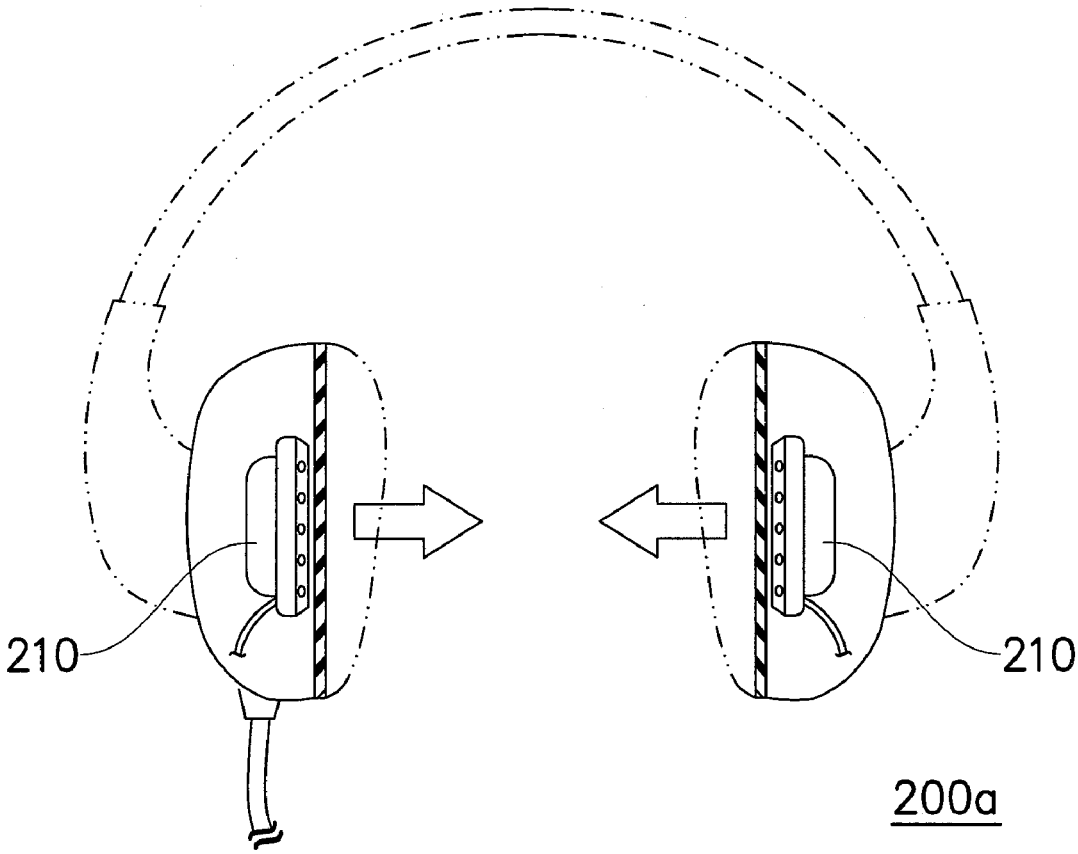
FIG. 2A (PRIOR ART)
FIG. 2A is a sectional diagram of a conventional earphone.
Figure 2B:
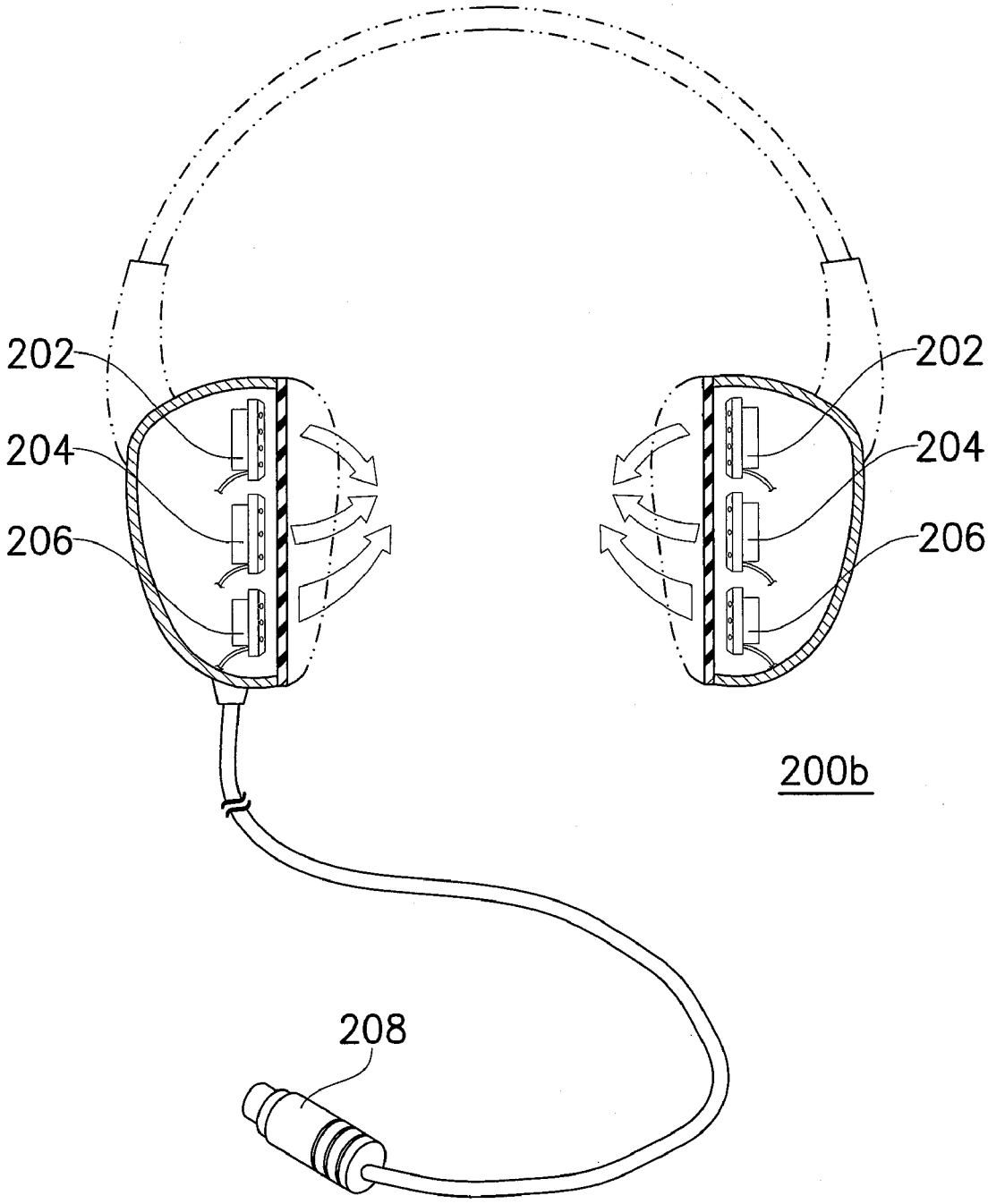
FIG. 2B (PRIOR ART)
FIG. 2B is a sectional diagram of another conventional earphone.
Figure 2C:
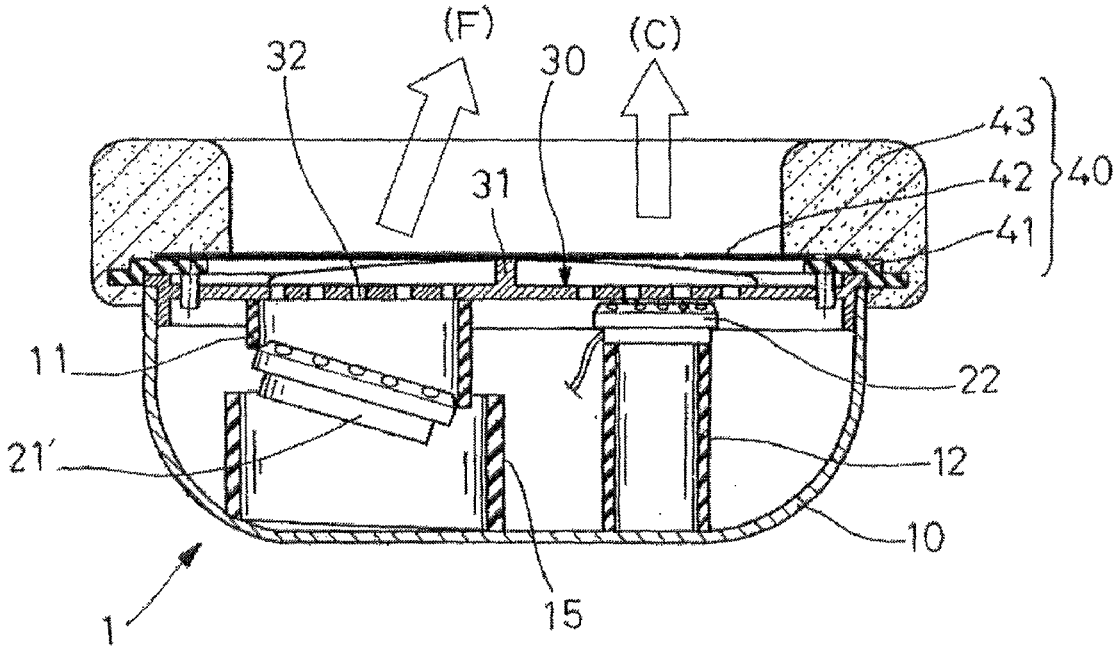
FIG. 2C (PRIOR ART)
FIGS. 2C, 2D, and 2E are the sectional diagrams of yet another conventional earphone, respectively.
Figure 2D:
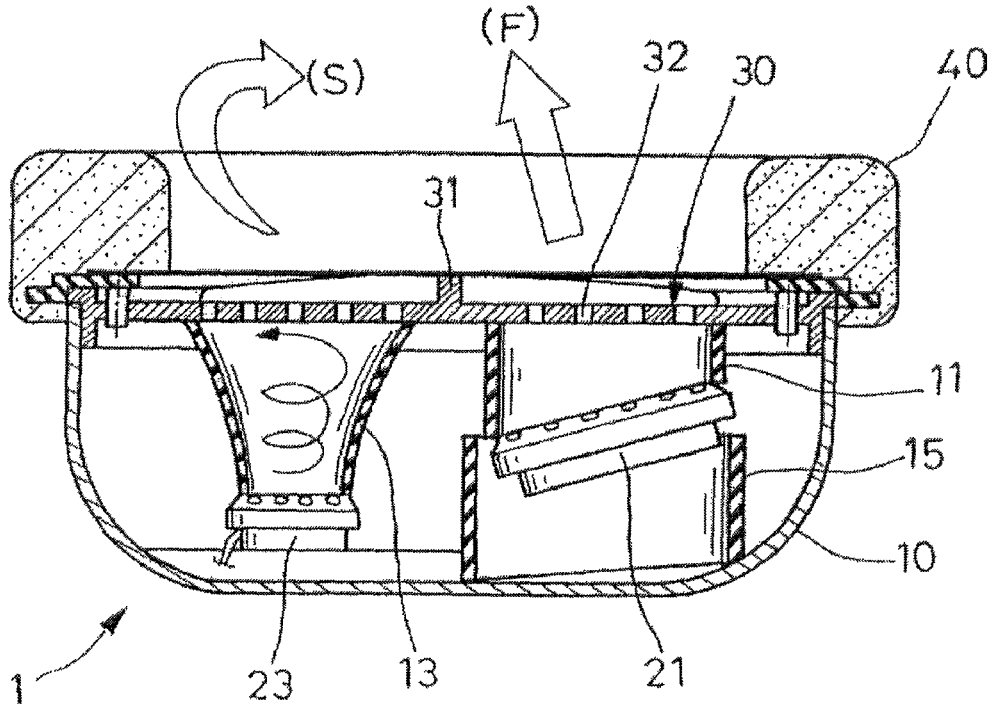
FIG. 2D (PRIOR ART)
Figure 2E:
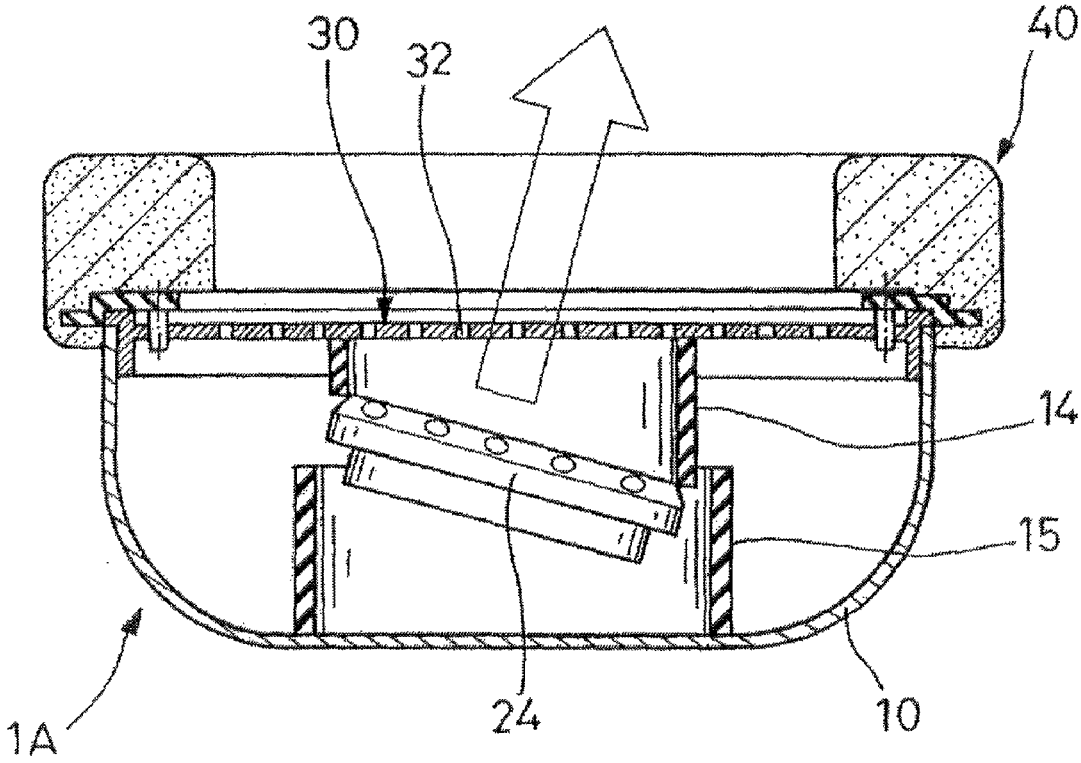
FIG. 2E (PRIOR ART)
Figure 3:
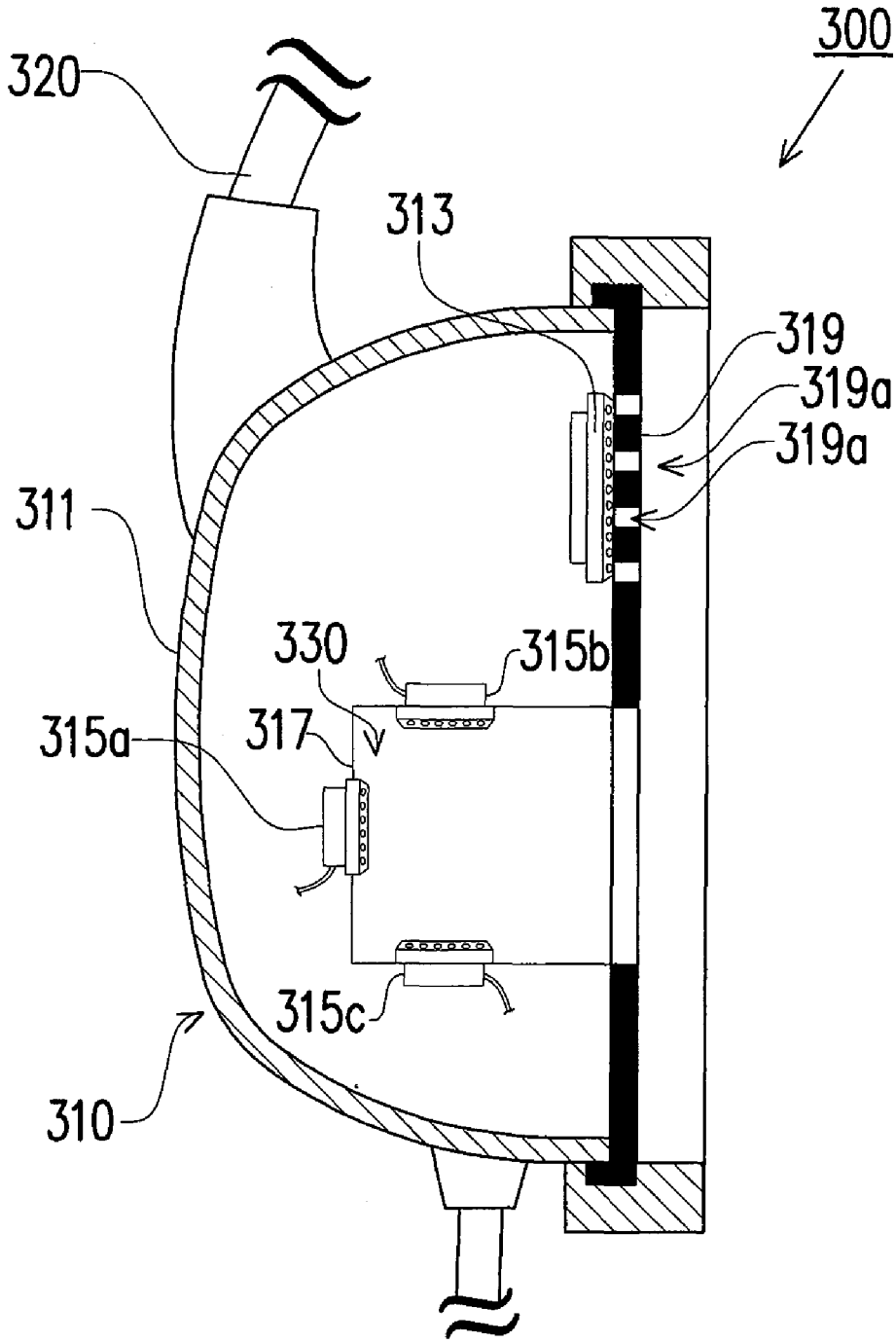
FIG. 3 is a partial sectional diagram of an earphone 300 according to an embodiment of the present invention.

FIG. 3 is a partial sectional diagram of an earphone 300 according to an embodiment of the present invention. It shall be noted that FIG. 3 only illustrates one side of the earphone of the present invention, and it shall be apparent to one of the ordinary skill in the art that the structure of the other side of the earphone is the same as the one shown in FIG. 3. Therefore, detail explanation of the structure of the other side of the earphone is omitted herein.

Referring to FIG. 3, the earphone 300 comprises an earphone main body 310 and a connection unit 320, wherein, the connection unit 320 connects the earphone main body 310 at the two sides (only one side is shown in the diagram). The earphone main body 310 mainly comprises a case 311, a main speaker 313, a plurality of sub-speakers 315*a*, 315*b*, and 315*c*, a composite chamber 317 for accommodating the sub-speakers 315*a*, 315*b*, and 315*c*, and a cover 319. The main speaker 313 and the sub-speakers 315*a*~315*c* are installed inside the case 311. The main speaker 313 and the composite chamber 317 are fixed on the cover 319. The sub-speakers 315*a*, 315*b*, and 315*c* are installed on the composite chamber 317, and share a 330 formed by the composite chamber 317, such that the sound wave generated by the composite room are uniformly distributed in the composite room so as to from a composite sound field, and to provide a good uniform diffusion sound pressure and a surround effect. Moreover, the portion of that of the sound field generated by each of these sub-speakers can be adjusted by re-locating the position of the sub-speaker according to the characteristic of each sub-speaker mentioned above. Details of which will be is explained hereinafter.

In an embodiment of the present invention, the main speaker 313 is for example, a front channel main speaker. The sub-speakers 315*a*~315*c* are for example, comprise a subwoofer speaker 315*a*, a first channel speaker 315*b*, and a second channel speaker 315*c*. Wherein, the subwoofer speaker 315*a* is for example installed on a back side of the composite chamber 317. When the sounds are propagated to the sub-speakers 315*a*~315*c* from an AV playing apparatus (not shown), the sound wave propagated from the subwoofer speaker 315*a*, the first channel speaker 315*b*, and the second channel speaker 315*c* are uniformly distributed in the composite room 330, such that sound pressure is balanced. In order to have a better sound quality, the sound signal may be a signal which had been processed by a sound field simulating process. For example, by using the frequency-divided point of each sub-speaker, such as the frequency-divided point of the sub-speakers 315*a*~315*c* shown in the diagram, and after the delay process is performed by the electronic signal delay processing circuitry, the best sound field is generated by the simulation. Therefore, the sub-speakers inside the same chamber do not interfered with each other, and a sound with very good uniform diffusion sound pressure and surround effect can be provided.

In an embodiment of the present invention, the composite chamber 317 forming the composite room 330 is constituted with a hollow column. Apparently, the shape of the composite room 330 is not necessarily limited to be the hollow column, any shape which can form a hollow cavity is suitable for the present invention. The cover 319 covers the case 311, and comprises a plurality of sound holes 319*a*, which is used to propagate the sound wave generated by the main speaker 313 inside the case 311 to the earphone main body 310.

Figure 3A:
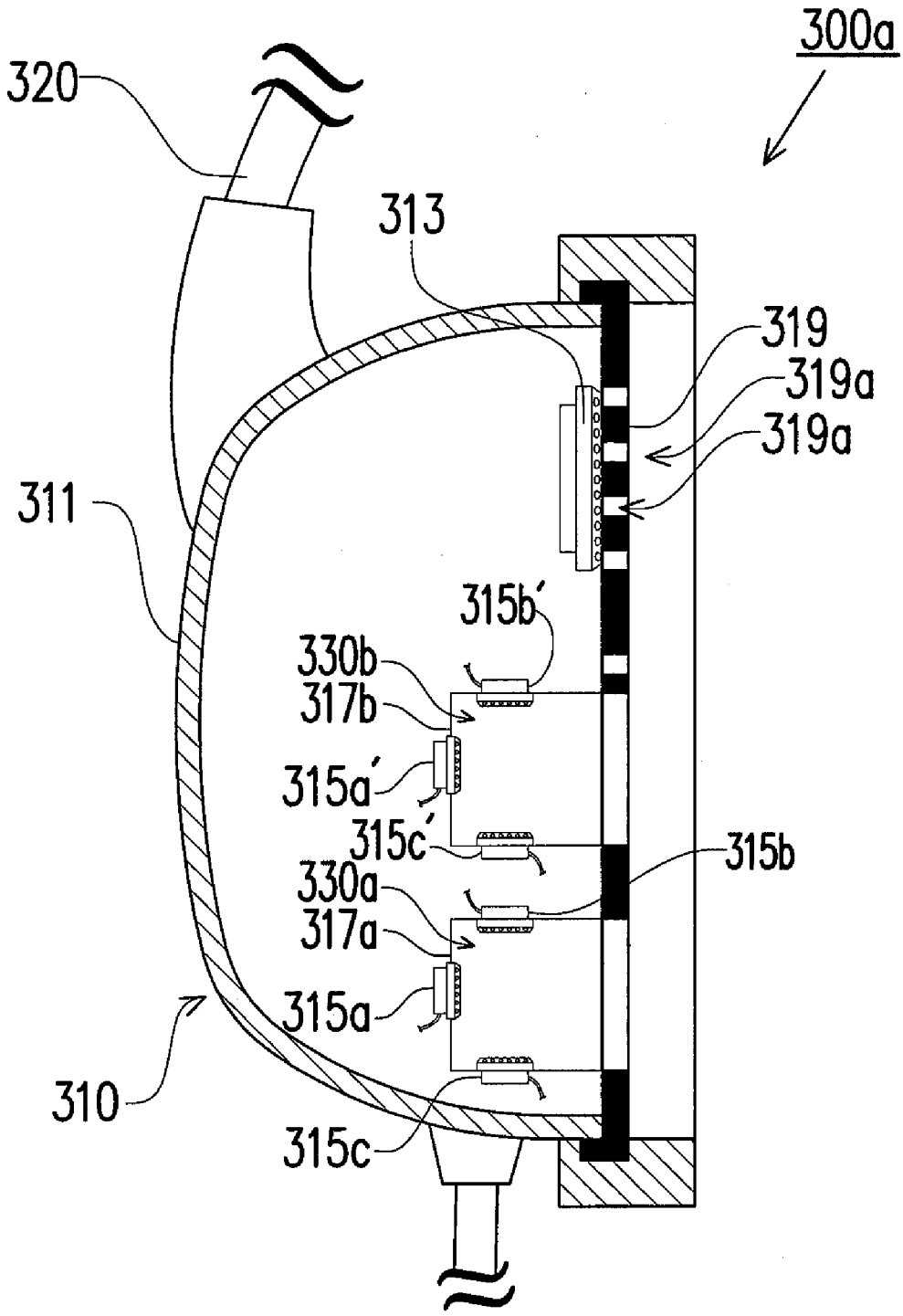
FIGS. 3A-3C are partial sectional diagrams of an earphone 300*a* according to another embodiments of the present invention.

FIG. 3A schematically shows the earphone 300 according to an embodiment of the present invention shown in FIG. 3. Based on the design requirement, more sets of composite room can be optionally added into the earphone 300*a* of FIG. 3A, so as to provide a very good uniformly extensive sound pressure and surround effect. As shown in FIG. 3A, the earphone 300*a* comprises two composite chambers 317*a* and 317*b*. The composite chamber 317*a* comprises the sub-speakers 315*a*, 315*b*, and 315*c* and forms a composite room 330*a*. The composite chamber 317*b* comprises the sub-speakers 315*a*', 315*b*', and 315*c*' and forms a composite room 330*b*. Apparently, although the earphone 300*a* shown in FIG. 3A describes an example of only two composite chambers, it will be apparent to one of the ordinary skill in the art that the earphone 300*a* may comprise two or more than two composite chambers.

Figure 3B:
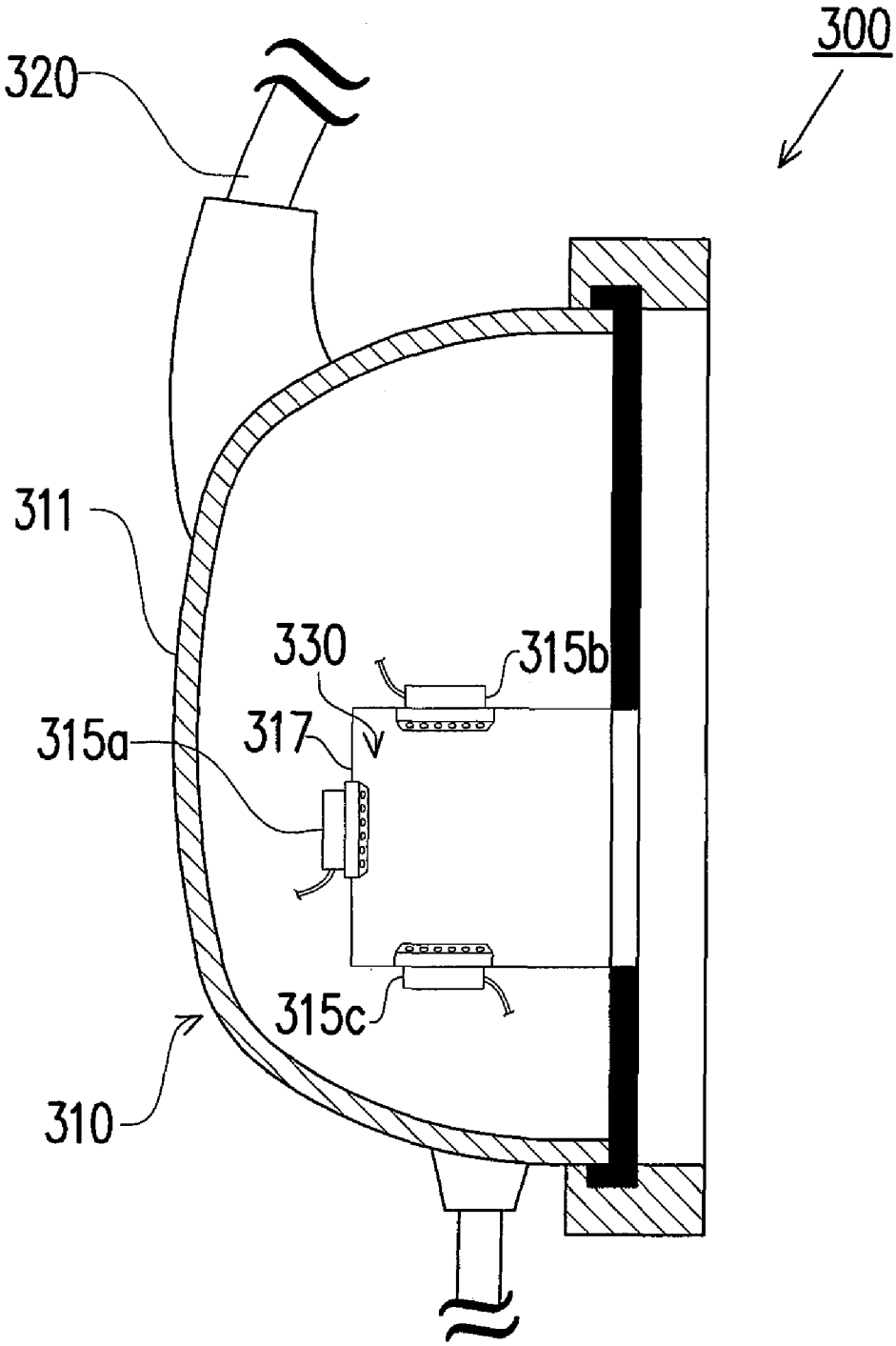

FIG. 3B schematically shows the earphone 300 according to another embodiment of the present invention shown in FIG. 3. Based on the design requirement, the main speaker 313 shown in FIG. 3 is not installed in the earphone 300 shown in FIG. 3B.

Figure 3C:
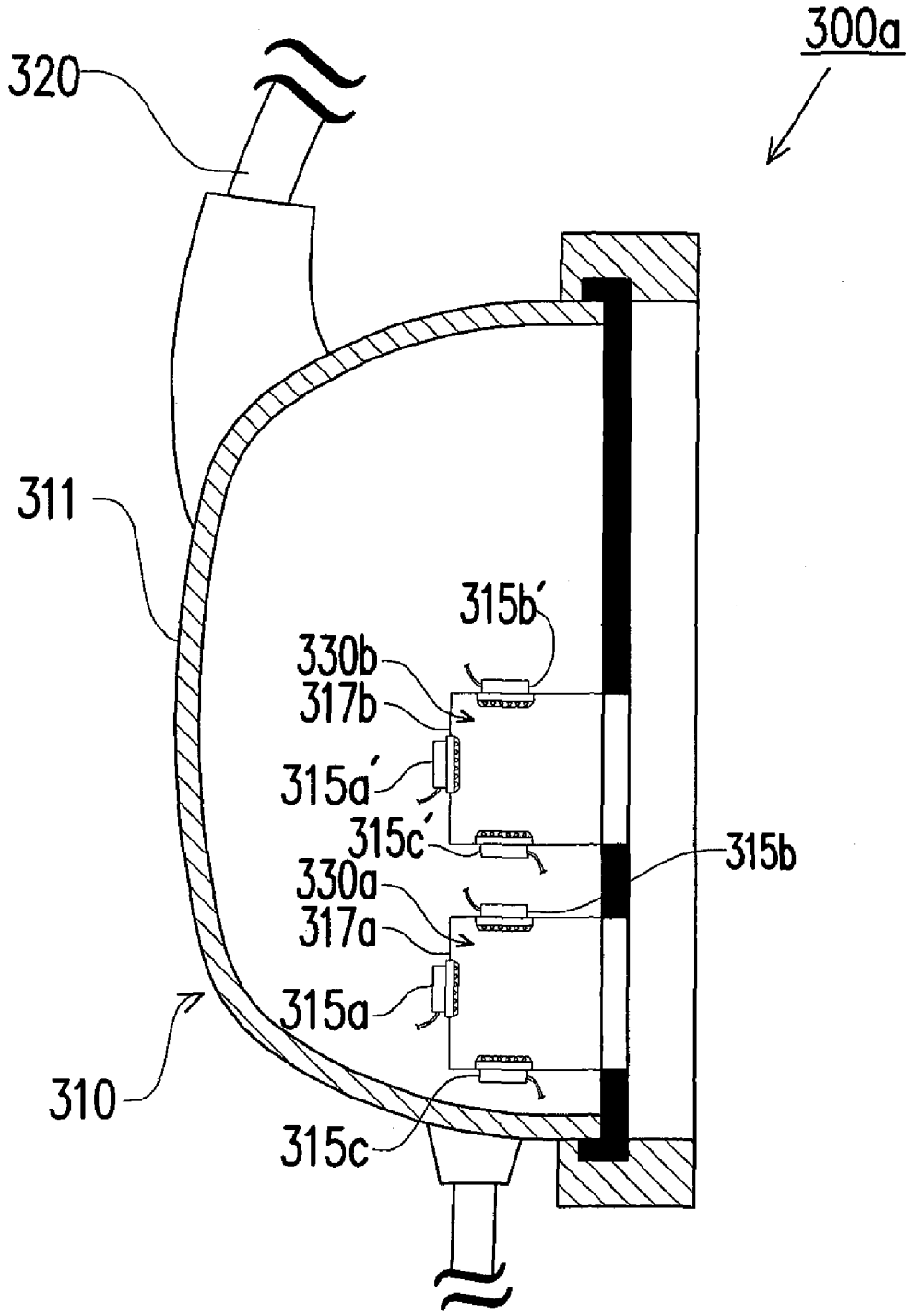

FIG. 3C schematically shows the earphone 300 according to another embodiment of the present invention shown in FIG. 3A. Based on the design requirement, the main speaker 313 shown in FIG. 3A is not installed in the earphone 300 shown in FIG. 3C.

Figure 4:
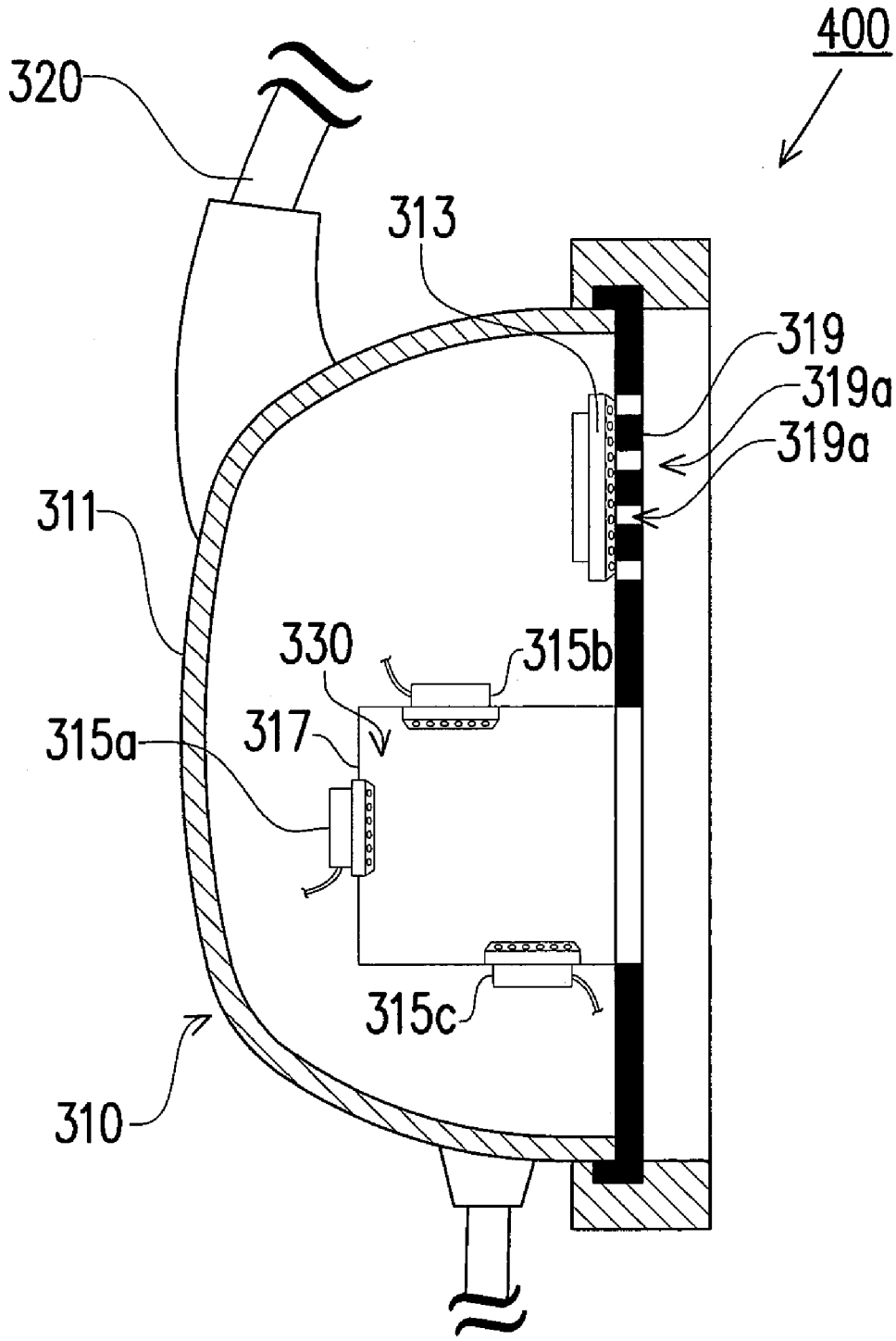
FIG. 4 is a partial sectional diagram of an earphone 400 according to yet another embodiment of the present invention.

Referring to FIG. 4, FIG. 4 schematically shows a partial sectional diagram of an earphone 400 according to yet another embodiment of the present invention. In the diagram, the same reference number is used to represent the element having the same function as the one shown in FIG. 3, and the detail explanation is omitted herein.

The sound field generated by the sub-speakers 315*a*~315*c* inside the composite room 330 can be adjusted by re-locating the position of the sub-speaker according to its characteristic, for example, by re-locating the sub-speaker in a front side or a back side of the composite chamber, or by re-locating the sub-speaker in different angles, in order to generate the composite sound field. The sound field generated by the main speaker 313 and the composite sound field generated by these sub-speakers in the composite chamber can form a spatial sound with very good quality. For example, if the first channel speaker 315*b* is a back surround channel speaker, and the second channel speaker 315*c* is for example a central channel speaker, the first channel speaker 315*b* and the second channel speaker 315*c* are asymmetrically installed inside the composite chamber 317. In other words, the first channel speaker 315*b* and the second channel speaker 315*c* are installed in the composite chamber 317 with one configured behind the other, such that the sound generated by the first channel speaker 316*b* is delayed for a certain time to form a composite sound field. In addition, the sound field generated by the main speaker and the composite sound field generated by these sub-speakers in the composite chamber can form a spatial sound with very good quality. Moreover, the sound generated by the earphone has a good uniform diffusion sound pressure and a surround effect, which allow a user of the earphone 400 to enjoy a sound field similar to that in a theater.

As mentioned above, in order to achieve a better sound quality for the earphone 400, the sound signal received by the earphone 400 may be a signal which had been processed by a sound field simulating process. For example, by using the frequency-divided point of each sub-speaker, and after the delay process performed by the electronic signal delay processing circuitry, the best sound field is generated by the simulation. Therefore, the sub-speakers inside the same chamber do not interfered with each other, and a sound with a very good uniform diffusion sound pressure and a surround effect can be provided.

Figure 4A:
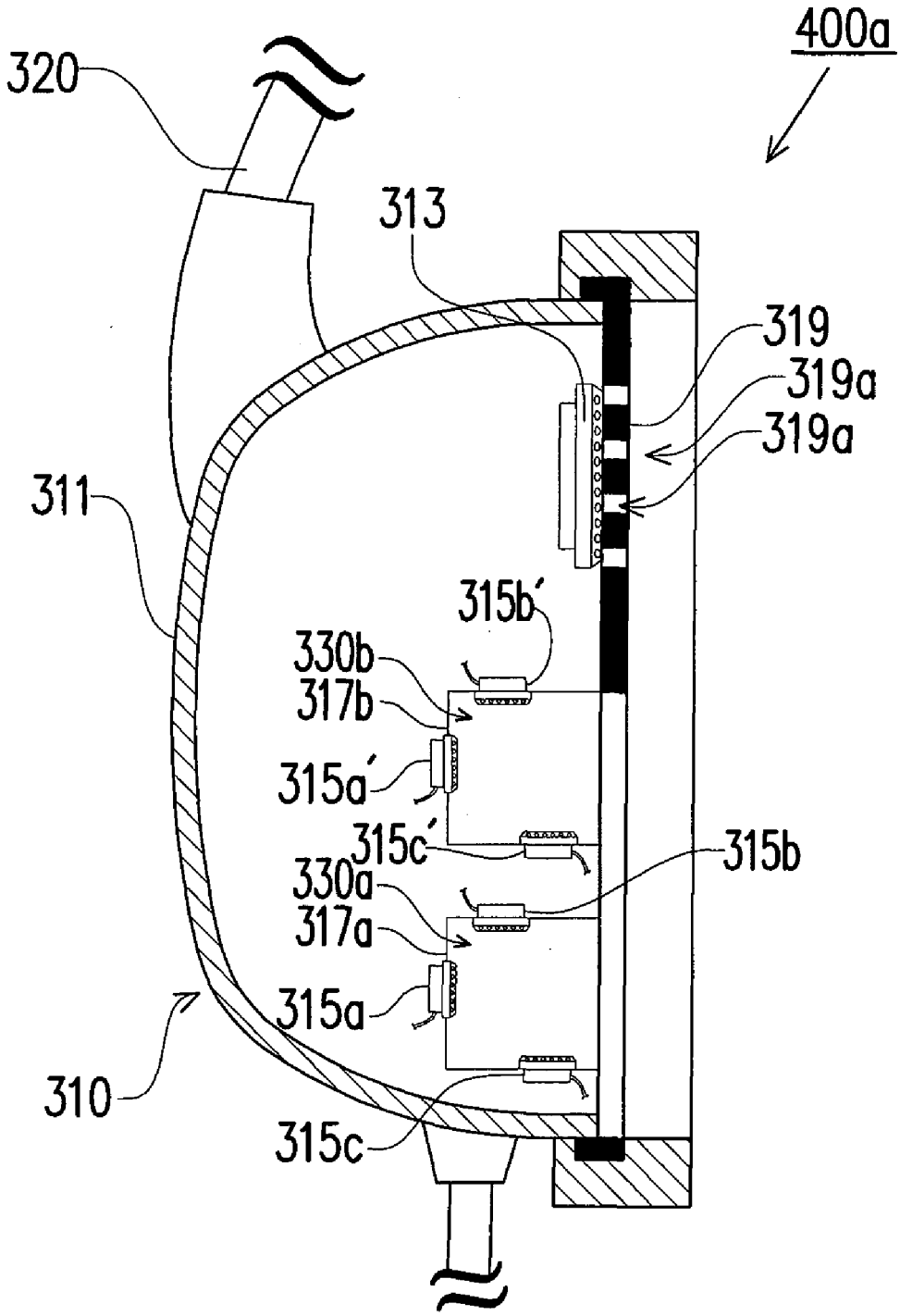
FIGS. 4A-4C are a partial sectional diagrams of an earphone 400*a* according to yet another embodiments of the present invention.

FIG. 4A schematically shows an earphone 400*a* according to an embodiment of the present invention shown in FIG. 4. Based on the design requirement, more sets of composite room can be optionally added into the earphone 400*a* of FIG. 4A, so as to provide a good uniform diffusion sound pressure and a surround effect. As shown in FIG. 4A, the earphone 400*a* comprises two composite chambers 317*a* and 317*b*. The composite chamber 317*a* comprises the sub-speakers 315*a*, 315*b*, and 315*c* and forms a composite room 330*a*. The composite chamber 317*b* comprises the sub-speakers 315*a*', 315*b*', and 315*c*' and forms a composite room 330*b*. Apparently, although the earphone 400*a* shown in FIG. 4A illustrates an example with only two composite chambers, it will be apparent to one of the ordinary skill in the art that the earphone 400*a* may comprise two or more than two composite chambers.

A room with a specific physical structure for the sub-speaker can be further designed in the present invention, such that a better sound quality can be achieved wherein, the physical structure depends on the physical design. For example, a diagram is used hereinafter to explain how to design a room with a specific physical structure for the first channel speaker 315*b* and the second channel speaker 315*c*.

Figure 4B:
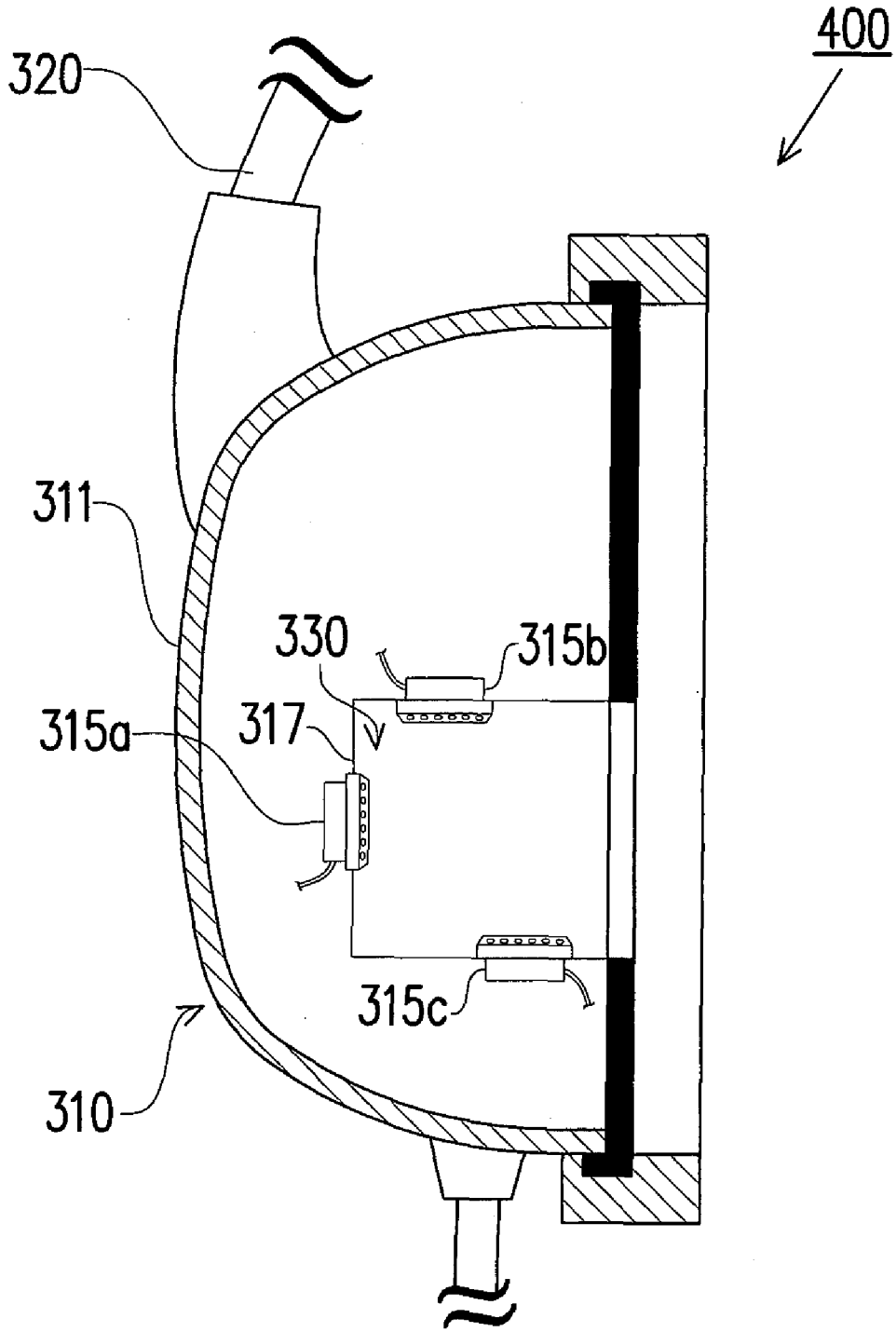

FIG. 4B schematically shows the earphone 400 according to another embodiment of the present invention shown in FIG. 4. Based on the design requirement, the main speaker 313 shown in FIG. 4 is not installed in the earphone 400 shown in FIG. 4B.

Figure 4C:
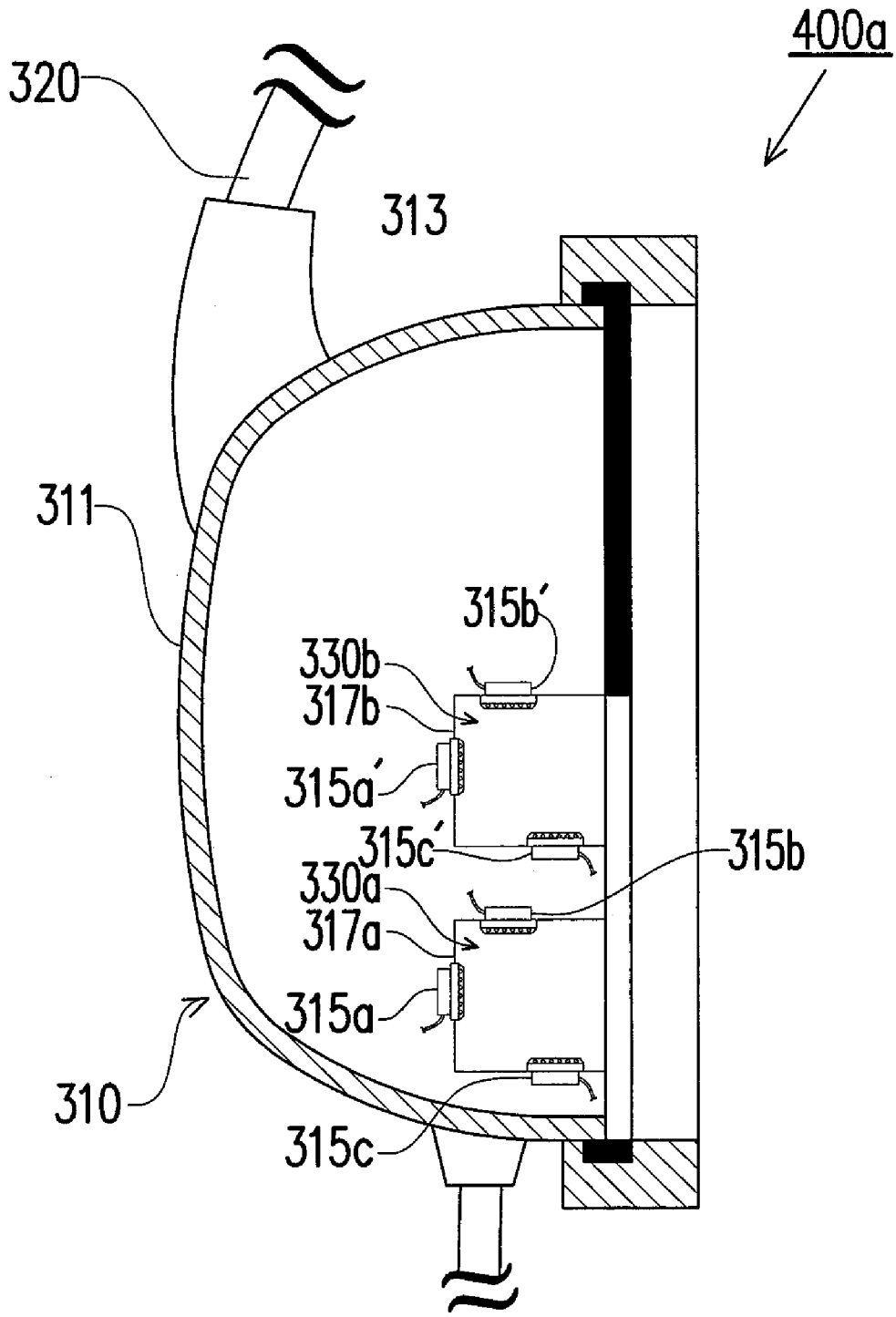

FIG. 4C schematically shows the earphone 400*a* according to another embodiment of the present invention shown in FIG. 4A. Based on the design requirement, the main speaker 313 shown in FIG. 4A is not installed in the earphone 400*a* shown in FIG. 4C.

Figure 5A:
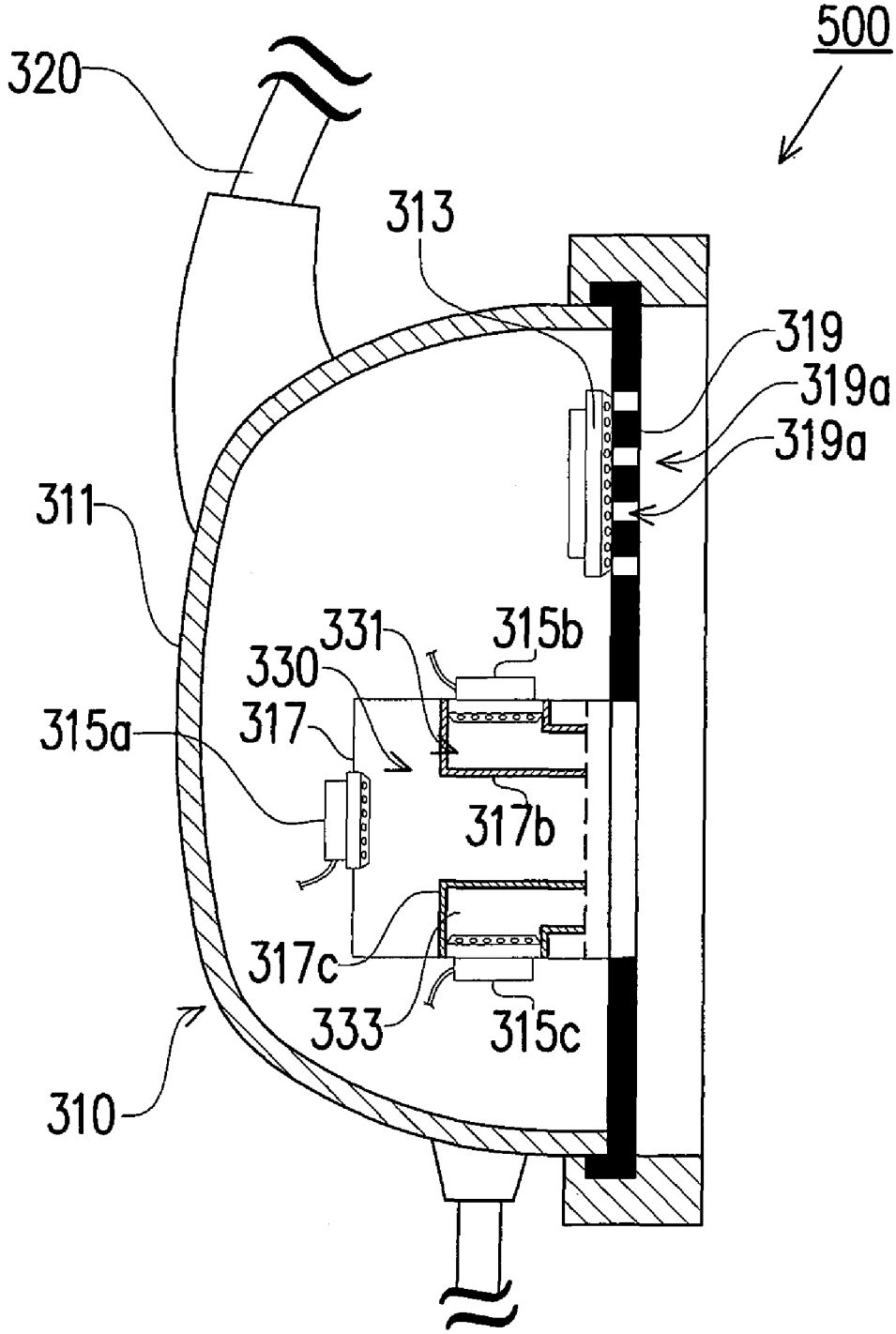
FIGS. 5A, 5B, 5C, and 5D are the partial sectional diagrams of an earphone 500 according to yet another embodiment of the present invention, respectively.

Referring to FIG. 5A, FIG. 5 schematically illustrates a partial sectional diagram of an earphone 500 according to yet another embodiment of the present invention. In the diagram, the same reference number is used to represent the element having the same function as the one shown in FIG. 3. The earphone 500 comprises an earphone main body 310 and a connection unit 320, wherein, the connection unit 320 connects the earphone main body 310 at both sides of the earphone 500 (only one side is shown in the diagram). The earphone main body 310 mainly comprises a case 311, a main speaker 313, a plurality of sub-speakers 315*a*, 315*b*, and 315*c*, a composite chamber 317 for accommodating the sub-speakers 315*a*, 315*b*, and 315*c*, and a cover 319. The main speaker 313 and the sub-speakers 315*a*~315*c* are installed inside the case 311. The main speaker 313 and the composite chamber 317 are fixed on the cover 319. The sub-speakers 315*a*, 315*b*, and 315*c* share a composite room 330 formed by the composite chamber 317.

In the present embodiment, The first channel speaker 315*b* and the second channel speaker 315*c* comprise a sub-room 331 and a sub-room 333, respectively. The sub-room 331 and the sub-room 333 are formed with the chambers 317*b* and 317*c*, respectively. In addition, the first channel speaker 315*b* and the second channel speaker 315*c* are fixed on the chambers 317*b* and 317*c*, respectively. It is known from the structure mentioned above that the sound generated by the first channel speaker 315*b* passes through the sub-room 317*b* first, then propagates to the composite room 330, and finally propagates to user's ear. Similarly, the sound generated by the second channel speaker 315*c* passes through the sub-room 317*c* first, then propagates to the composite room 330, and finally propagates to user's ear, wherein, the chambers 317*b* and 317*c* are physical structures with special designs. For example, the chambers 317*b* and 317*c* may be constituted by a curve tube. Alternatively, a grid plate can be used to generate a plurality of rooms inside the composite room 330, and these rooms are used as sub-rooms 331 and 333 for the first channel speaker 315*b* and the second channel speaker 315*c*, respectively.

The design of the chambers 317*b* and 317*c* are mainly focused on forming a room with a specific physical structure. As shown in the diagram, there is a small distance between the chambers 317*b* and 317*c* and the case 319. In other words, after the sound wave propagates from sub-rooms 331 and 333, respectively through the first channel speaker 315*b* and the second channel speaker 315*c*, the sound wave will through the composite room 330 first, and then to the user's ear through the earphone 500. The principle for this design is described in details hereinafter. First, for reducing the tube-tone phenomenon, based on the basic acoustic theory, the longer the distance a sound wave has to propagated in an enclosed chamber, namely the longer the propagation distance, the more serious the distortion will be. As a result, the power required to propagate the sound wave is higher; and in other words, a higher sound pressure is required. In addition, when the sound wave propagates in the enclosed chamber, from a tube with a smaller diameter to a tube with a larger diameter, the probability of resonance increases. In other words, the sound pressure is increased to enhance the propagated effect.

The structure of the chambers 317*b* and 317*c*, for example, a curve tube, may have a predetermined curve angle, such that the sounds propagated in the sub-rooms 331 and 333 can form a very good uniform diffusion sound pressure and a surround effect due to the characteristic of the physical structure of the chambers 317*b* and 317*c*. According to the experimental study performed for the present invention, the predetermined curve angle is for example, within a range of 80-100 degrees. In such a range, based on the changes of physical characteristics of the sound wave, a more saturated sound field is propagated, such that the width and the depth of the sound field are further improved.

Figure 5B:
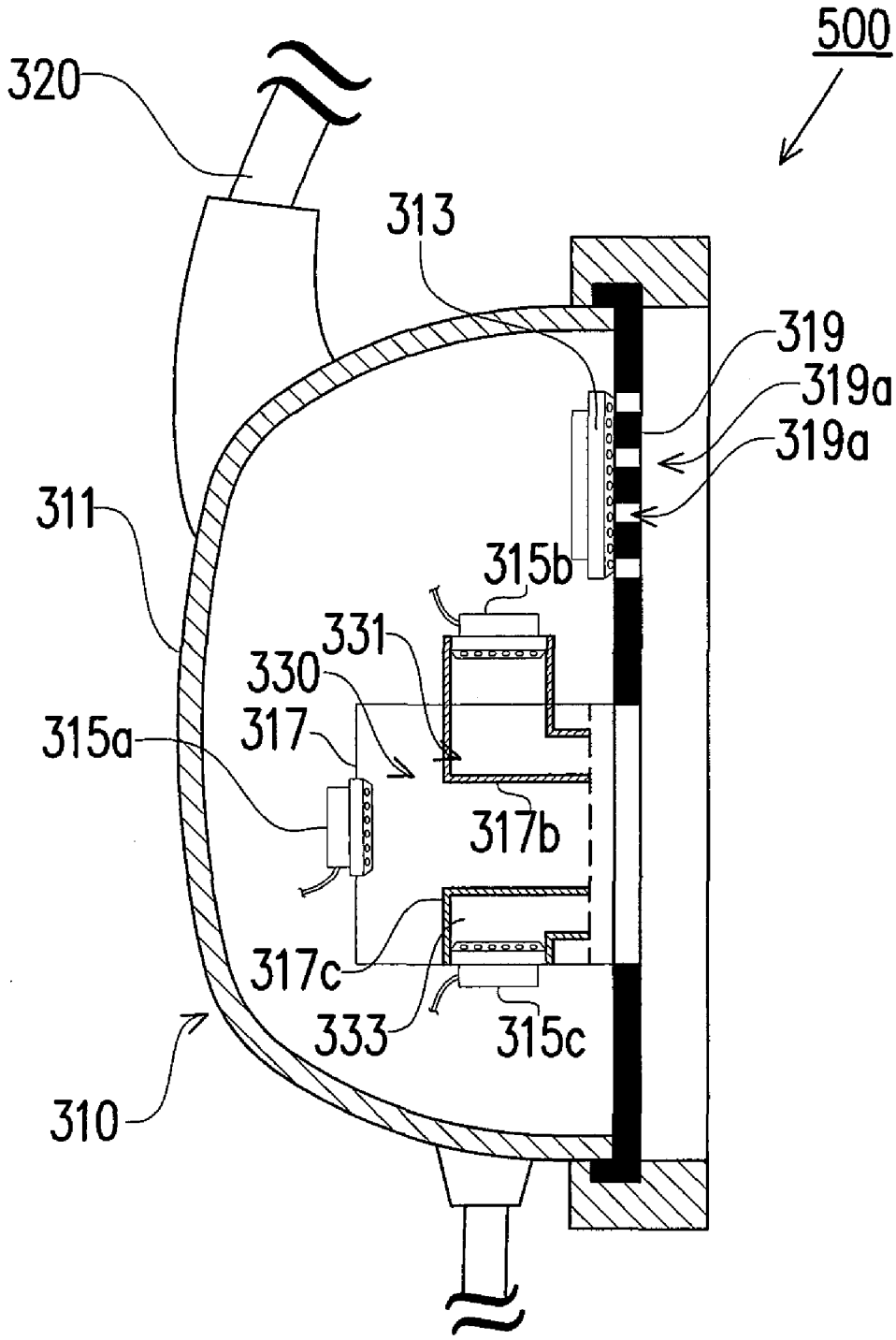

Referring to FIG. 5B, FIG. 5B schematically illustrates a partial sectional diagram of an earphone 500 according to yet another embodiment of the present invention. The same reference number is used to represent the element having the same function as the one shown in FIG. 3. The earphone 500 comprises an earphone main body 310 and a connection unit 320, wherein, the connection unit 320 connects the earphone main body 310 at both sides of the earphone 500 (only one side is shown in the diagram). The earphone main body 310 mainly comprises a case 311, a main speaker 313, a plurality of sub-speakers 315*a*, 315*b*, and 315*c*, a composite chamber 317 for accommodating the sub-speakers 315*a*, 315*b*, and 315*c*, and a cover 319. The main speaker 313 and the sub-speakers 315*a*~315*c* are installed inside the case 311. The main speaker 313 and the composite chamber 317 are fixed on the cover 319. The sub-speakers 315*a*, 315*b*, and 315*c* share a composite room 330 formed by the composite chamber 317. The first channel speaker 315*b* and the second channel speaker 315*c* comprise a sub-room 331 and a sub-room 333, respectively, wherein, the sub-room 331 and the sub-room 333 are formed with the chambers 317*b* and 317*c*, respectively. In addition, the first channel speaker 315*b* and the second channel speaker 315*c* are fixed on the chambers 317*b* and 317*c*, respectively.

The difference between the present embodiment and the earphone 500 in FIG. 5A is in the design of the chamber 317*b*. The length of the sub-room 331 of the first channel speaker 315*b* formed by the chamber 317*b* is intentionally extended, such that the delay time can be increased. In other words, the width and the depth of the sound field can be improved.

Figure 5C:
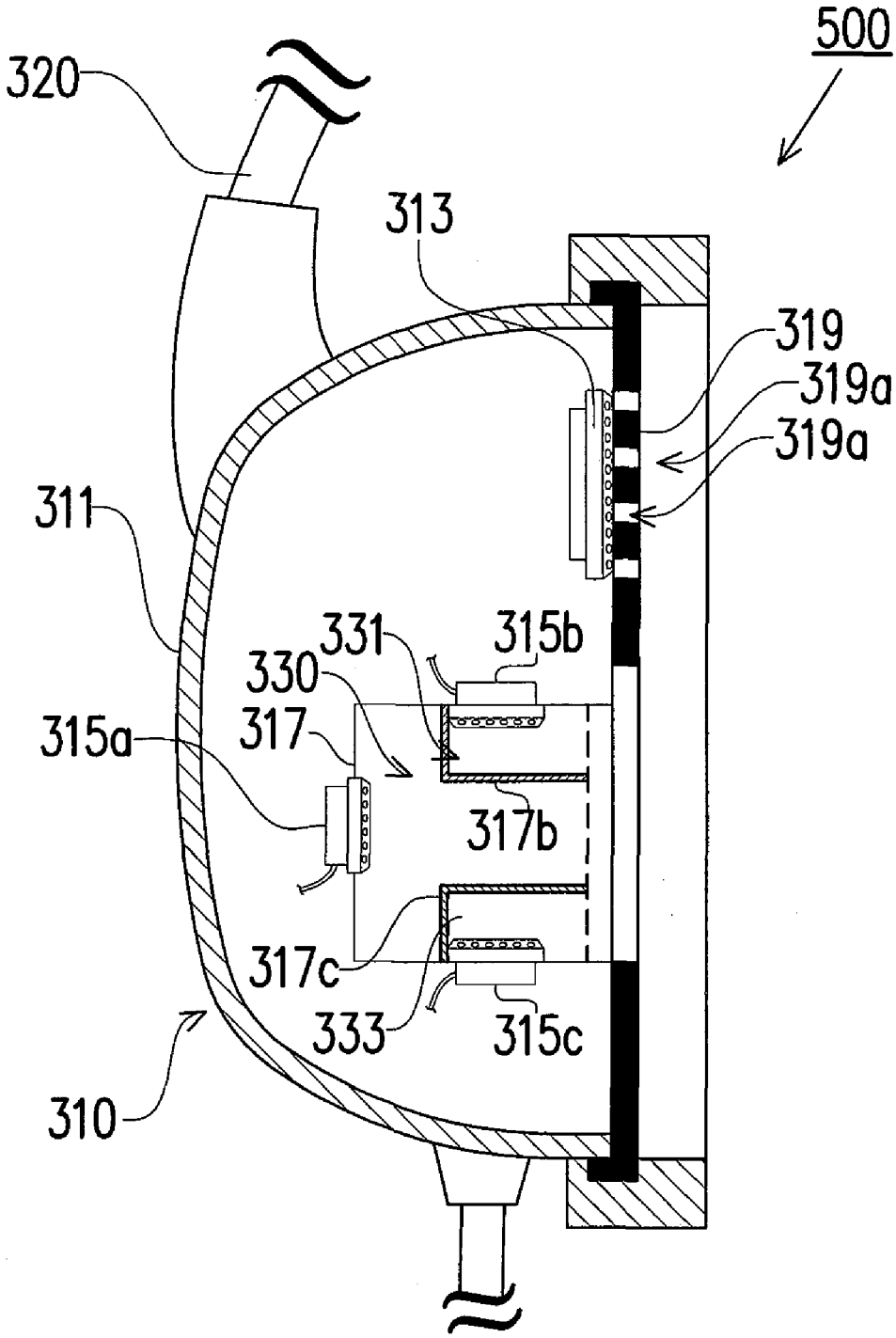

Referring to FIG. 5C, FIG. 5C schematically illustrates a partial sectional diagram of an earphone 500 according to yet another embodiment of the present invention. The same reference number is used to represent the element having the same function as the one shown in FIG. 3. The earphone 500 comprises an earphone main body 310 and a connection unit 320, wherein, the connection unit 320 connects the earphone main body 310 at both sides of the earphone 500 (only one side is shown in the diagram). The earphone main body 310 mainly comprises a case 311, a main speaker 313, a plurality of sub-speakers 315*a*, 315*b*, and 315*c*, a composite chamber 317 for accommodating the sub-speakers 315*a*, 315*b*, and 315*c*, and a cover 319. The main speaker 313 and the sub-speakers 315*a*~315*c* are installed inside the case 311. The main speaker 313 and the composite chamber 317 are fixed on the cover 319. The sub-speakers 315*a*, 315*b*, and 315*c* share a composite room 330 formed by the composite chamber 317. The first channel speaker 315*b* and the second channel speaker 315*c* comprise a sub-room 331 and a sub-room 333, respectively, wherein, the sub-room 331 and the sub-room 333 are formed with the chambers 317*b* and 317*c*, respectively. In addition, the first channel speaker 315*b* and the second channel speaker 315*c* are fixed on the chambers 317*b* and 317*c*, respectively.

The difference between the present embodiment and the earphone 500 in FIG. 5A is in the design of the chambers 317*b* and 317*c*. As mentioned above, the design of the chambers 317*b* and 317*c* are mainly focused on forming a room with a specific physical structure. As shown in FIG. 5C, the structure for forming the chambers 317*b* and 317*c*, for example, a grid plate, may have a predetermined curve angle, such that the sound wave that propagated in the sub-rooms 331 and 333 can form a uniform diffusion sound pressure and a surround effect due to the characteristic of the physical structure of the chambers 317*b* and 317*c*. According to the experiment performed for the present invention, the predetermined curve angle is for example, within a range of 80-100 degrees. In such a range, based on the changes of the physical characteristic of the sound wave, a more saturated sound field is propagated, such that the width and the depth of the sound field are further improved.

Figure 5D:
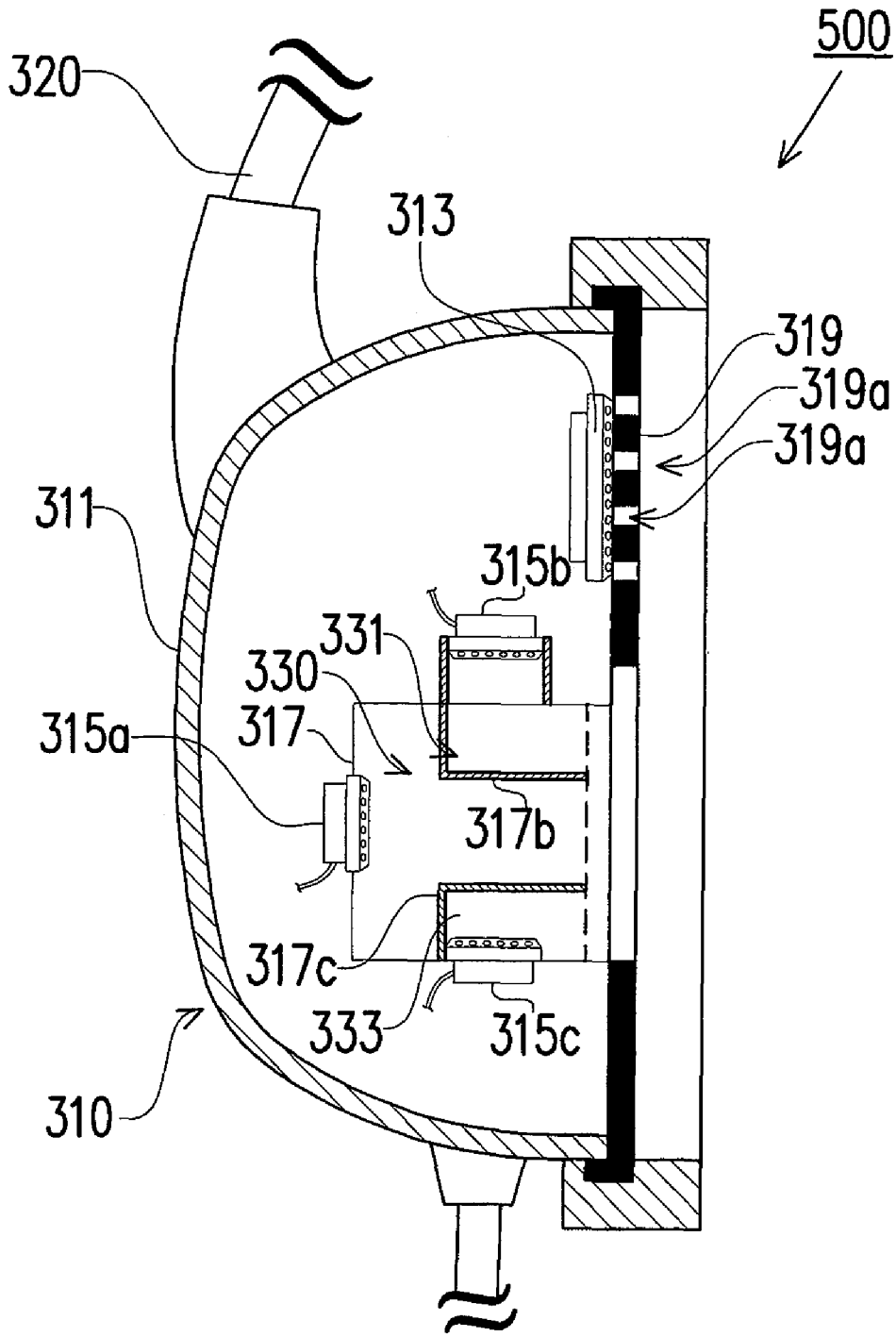

Referring to FIG. 5D, FIG. 5D schematically illustrates a partial sectional diagram of an earphone 500 according to yet another embodiment of the present invention. Similar to the earphone 500 in FIG. 5A, the length of the sub-room 331 of the first channel speaker 315*b* formed with the chamber 317*b* of the present embodiment is extended intentionally, such that the delay time can be increased. In other words, the width and the depth of the sound field can be improved.

Figure 6:
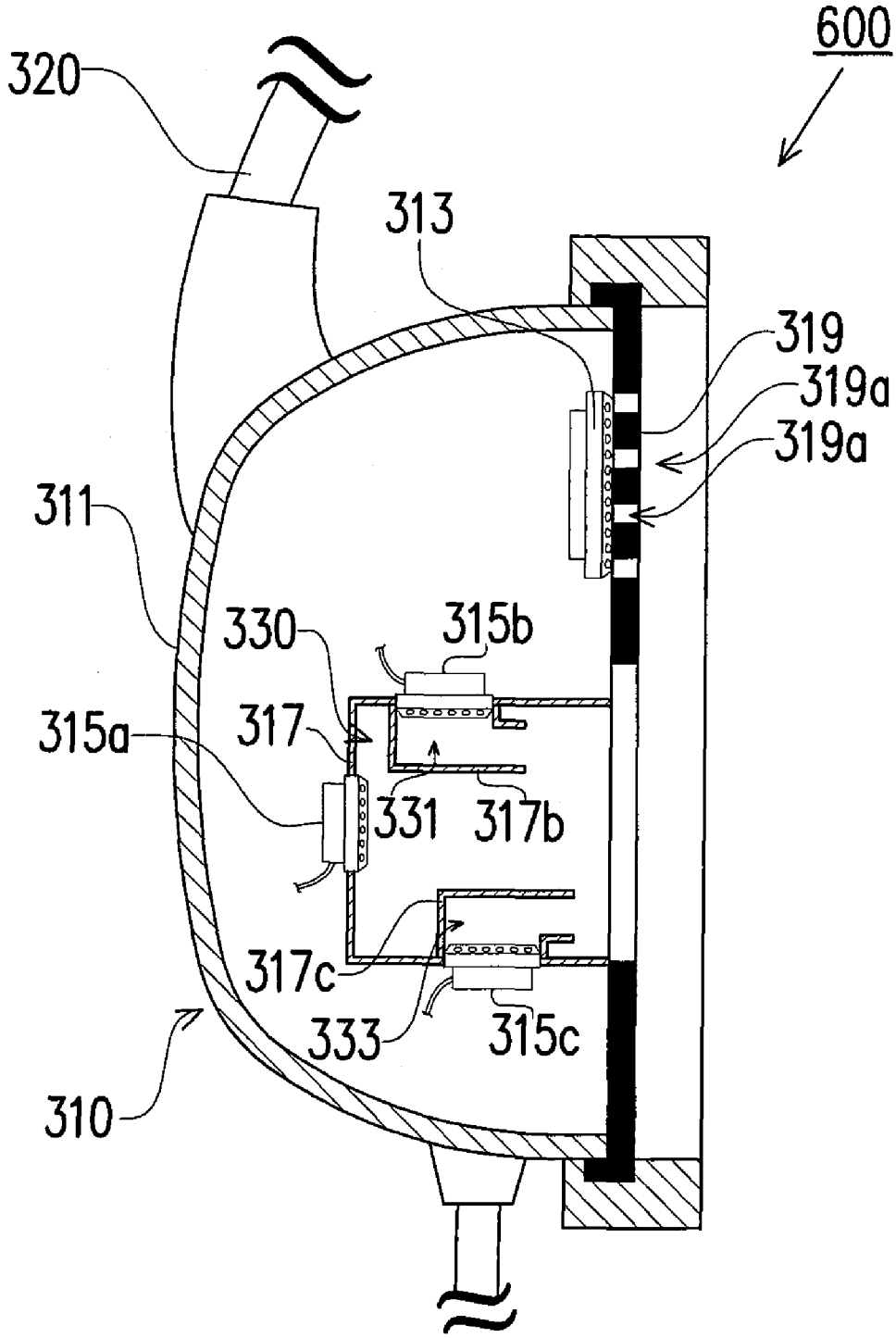
FIG. 6 is a partial sectional diagram of an earphone 600 according to yet another embodiment of the present invention.

In yet another embodiment of the present invention, as mentioned above, the first channel speaker 315*b* and the second channel speaker 315*c* of FIG. 5 are disposed on the composite chamber 317 in a manner with one next to the other according to the characteristics of the first channel speaker 315*b* and the second channel speaker 315*c*. A difference in distance between the sub-room 331 and the sub-room 333 is thus formed, such that the sound field generated by the main speaker 313 and the composite sound field generated by these sub-speakers in the composite chamber can form a spatial sound with very good quality, and the sound has an uniform diffusion sound pressure and a surround effect. The earphone of this embodiment is shown in FIG. 6.

Figure 6A:
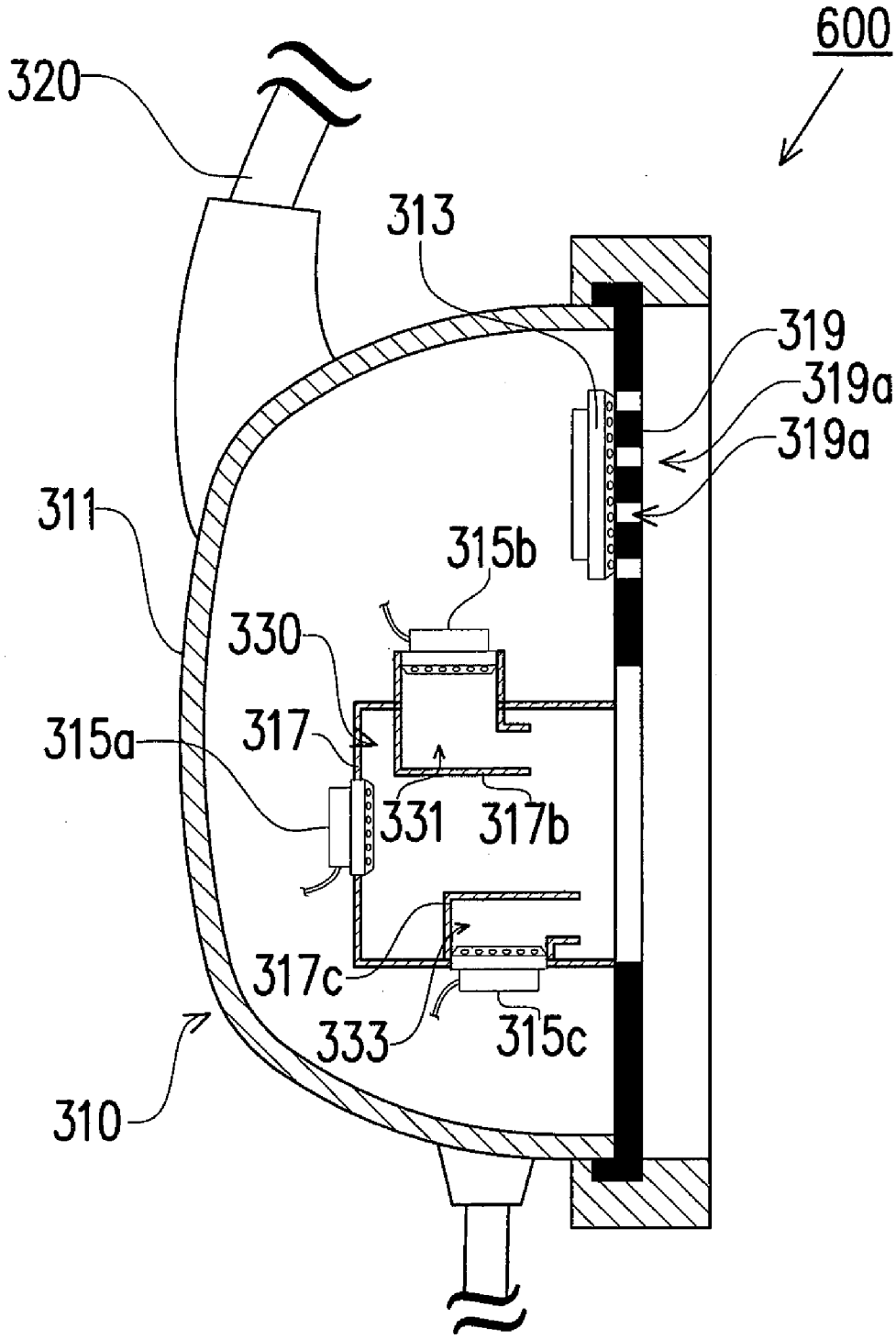
FIGS. 6A and 6B are the partial sectional diagrams of an earphone 600 according to yet another embodiment of the present invention, respectively.

As mentioned above, it is also possible to have different designs for the chamber of the earphone 600 in the present invention. For example, the length of the sub-room 331 of the first channel speaker 315*b* formed by the chamber 317*b* is extended intentionally. As a result, the delay time can be increased, and in other words, the width and the depth of the sound field can be improved. The earphone of this embodiment is shown in FIG. 6A.

Figure 6B:
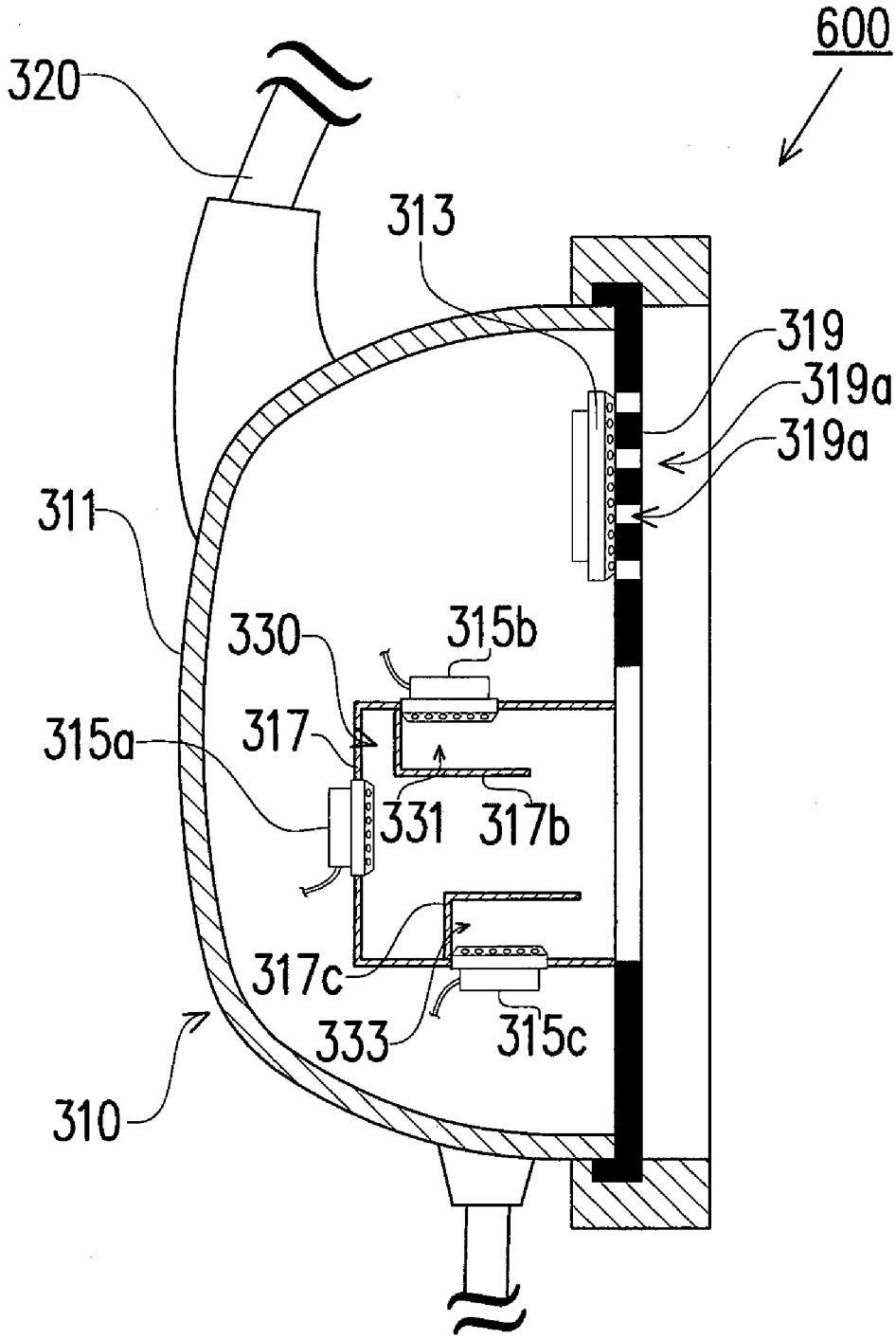

Moreover, as mentioned above, it is also possible to have a different design for the chamber of the earphone 600 in the present invention, and the earphone of this embodiment is shown in FIG. 6B. For example, the difference between the earphone 600 of the present embodiment and the earphone 600 in FIG. 6 is in the design of the chambers 371*b* and 317*c*. As mentioned above, the design of the chambers 317*b* and 317*c* are mainly focused on forming a room with a specific physical structure. As shown in FIG. 6B, the structure for forming the chambers 317*b* and 317*c*, for example, a grid plate, may have a predetermined curve angle, such that the sound wave propagates in the sub-rooms 331 and 333 can form a very good uniform diffusion sound pressure and a surround effect due to the characteristic of the physical structure of the chambers 317*b* and 317*c*. It is known from the experiment according to the present invention, the predetermined curve angle is for example, within a range of 80-100 degrees. In such a range, based on the change of the sound wave's physical characteristic, a more saturated sound field is propagated, such that the width and the depth of the sound field are further improved.

Figure 7:
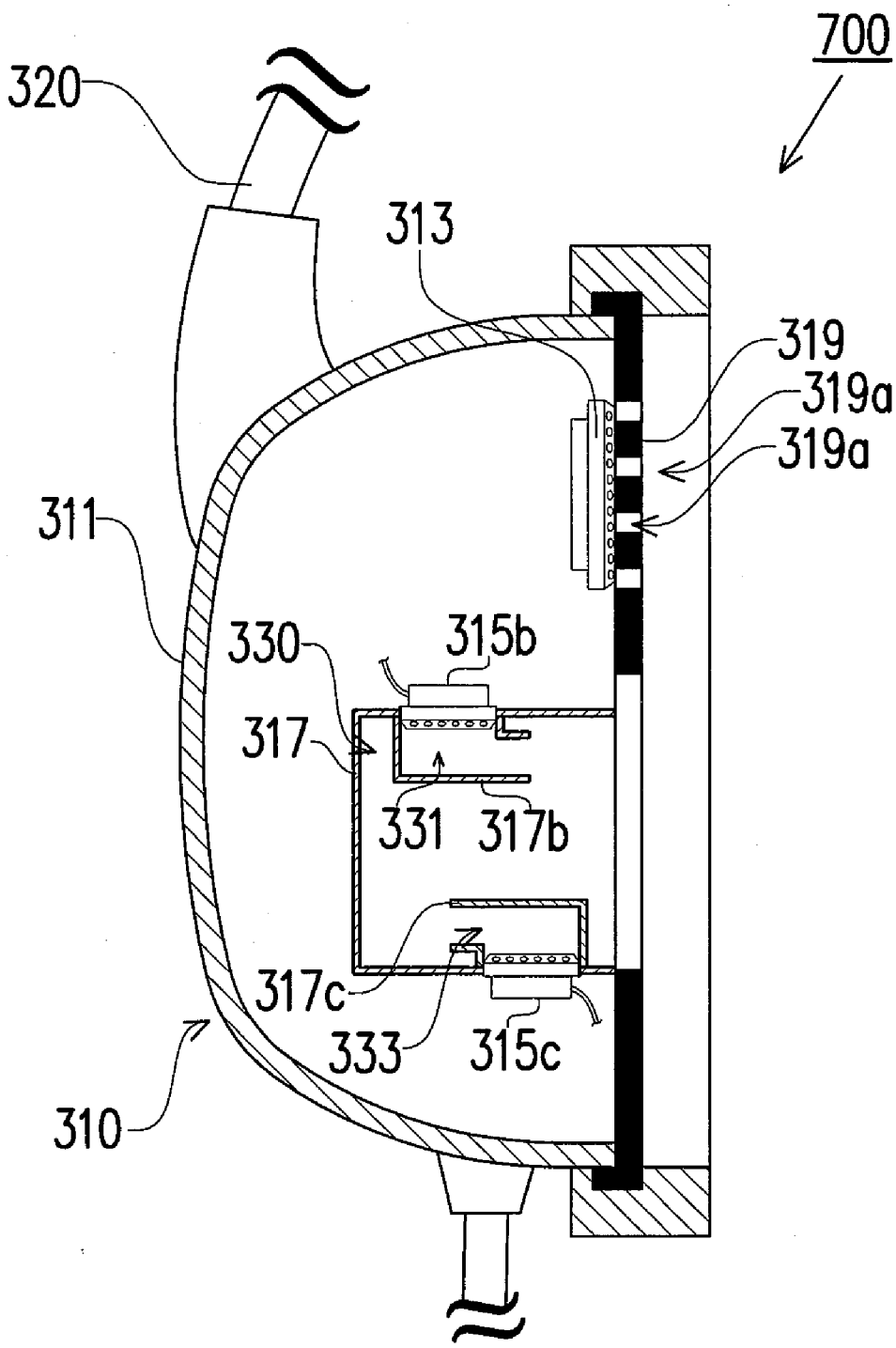
FIG. 7 is a partial sectional diagram of an earphone 700 according to yet another embodiment of the present invention.

In yet another embodiment of the present invention, the opening direction of the chambers 317*b* and 317*c* for forming the sub-rooms 331 and 333 can be adjusted according to the characteristics of the first channel speaker 316*b* and the second channel speaker 316*c*. For example, the first channel speaker 316*b* and the second channel speaker 316*c* can face different directions. Referring to FIG. 7, FIG. 7 schematically illustrates a partial sectional diagram of an earphone 700 according to yet another embodiment of the present invention. The opening of the chamber 317*b* faces the cover 319, whereas the opening of the chamber 317*c* faces the other side of the composite room 330. Therefore, after the sound wave generated by the second channel speaker 316*c* passes through the sub-room 333, is the sound wave is reflected by the internal wall of the composite room 330 and then propagated to the user. Accordingly, with such a design, the drawback of an insufficient internal space of the earphone can be compensated. The time difference between the sound wave generated by the first channel speaker 315*b*. and the sound generated by the second channel speaker 315*c* to propagate out the earphone main body 310 is thus increased. Consequently, the depth of the sound field generated by the earphone 700 is further improved.

Figure 7A:
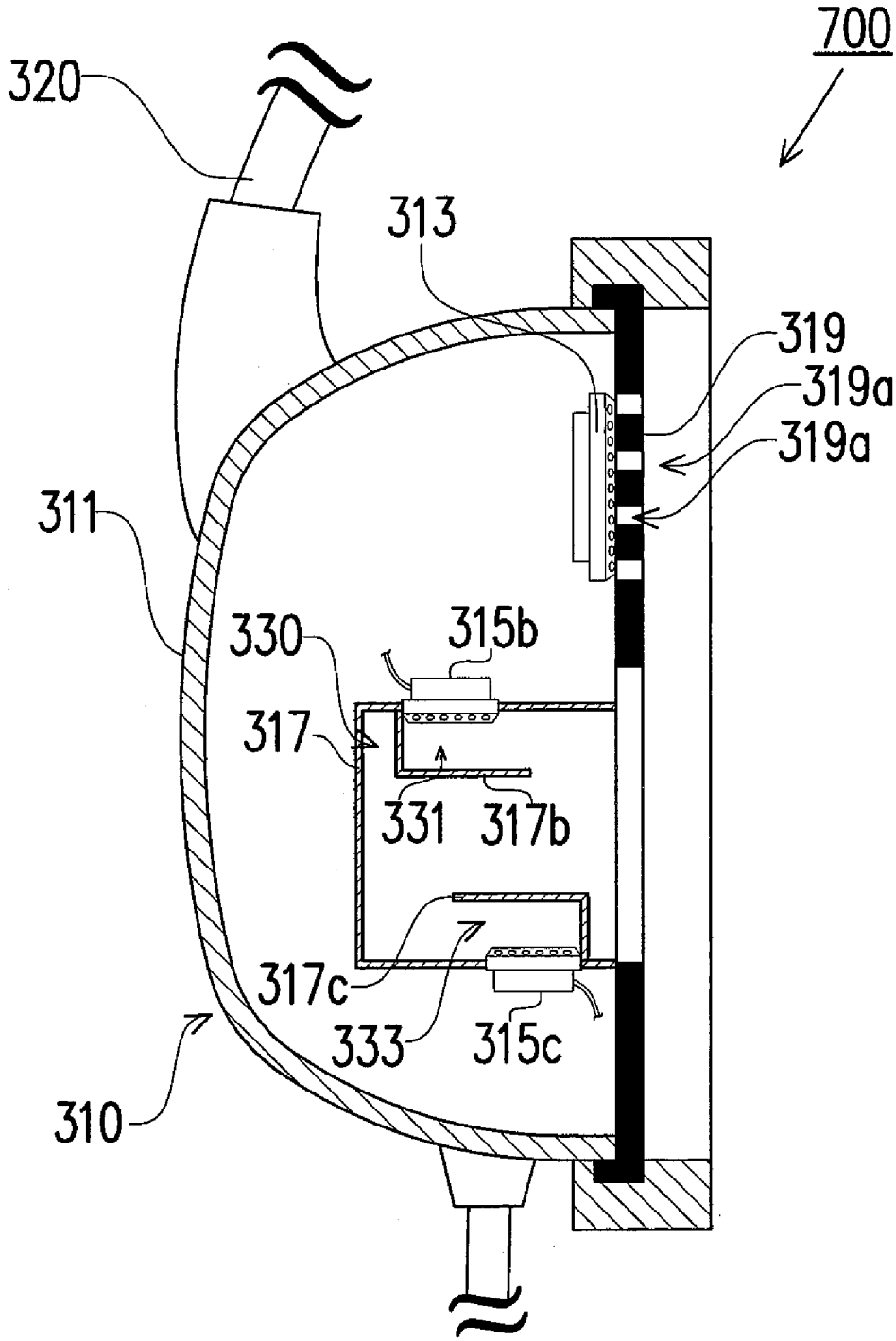
FIG. 7A is a partial sectional diagram of an earphone 600 according to yet another embodiment of the present invention.

Moreover, as mentioned above, it is also possible to have a different design for the chamber of the earphone 700 in the present invention, and the earphone of this embodiment is shown in FIG. 7A. For example, the difference between the earphone 700 of the present embodiment and the earphone 700 in FIG. 7 is in the design of the chambers 371*b* and 317*c*. As mentioned above, the design of the chambers 317*b* and 317*c* are mainly focused on forming a room with a specific physical structure. As shown in FIG. 7B, the structure for forming the chambers 317*b* and 317*c*, for example, a grid plate, may have a predetermined curve angle, such that the sound wave that propagated in the sub-rooms 331 and 333 can form a very good uniform diffusion sound pressure and a surround effect due to the characteristic of the physical structure of the chambers 317*b* and 317*c*. According to the experiment performed for to the present invention, the predetermined curve angle is for example, within a range of 80-100 degrees. In such a range, based on the change of the sound wave's physical characteristic, a more saturated sound field is propagated, such that the width and the depth of the sound field are further improved.

Apparently, in all the embodiments mentioned above, a sponge or a soft cloth (not shown) may further cover the cover 319, so as to avoid the uncomfortable feeling of the user for wearing the earphone for a long time.

In summary, the earphone structure provided by the present invention provides a plurality of sub-speakers sharing a composite room, such that the sound wave generated by these sub-speakers are uniformly distributed in the composite chamber and a composite sound field is generated by these sub-speakers in the composite chamber. The sound field generated by each of these sub-speakers can be adjusted by re-locating the position of the sub-speaker according to its characteristic, for example, by re-locating the sub-speaker in a front side or a back side of the composite chamber, or by re-locating the sub-speaker in different angles, in order to generate the composite sound field. The sound field generated by the main speaker and the composite sound field generated by these sub-speakers in the composite chamber can form a spatial sound with very good quality. By taking advantage of the physical characteristics of the locations of these sub-speakers, the sound generated by the earphone has a very good uniform diffusion sound pressure and a surround effect, which allow the customer of the earphone to enjoy a sound field similar to that in a theater.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An earphone structure, comprising:

a case;

a cover, mounted on an opening of the case, and defining a space together with the case;

a main speaker fixed on a portion of the cover for generating a sound wave to configure a sound field, wherein the sound field and the composite sound field are mixed as the output of the earphone structure;

a composite chamber, accommodated in the space defined by the case and the cover, and fixed on another portion of the cover, wherein the composite chamber defines a composite room together with the cover on which it is fixed; and a plurality of sub-speakers disposed inside the composite chamber for generating sound waves and mixing the generated sound waves in the composite chamber so as to configure a composite sound field in the composite room, wherein at least one of the sub-speakers further comprises a sub-room with a specific physical structure inside the composite chamber.

2. The earphone structure of claim 1, wherein each of the sub-rooms is formed with a corresponding chamber.

3. The earphone structure of claim 2, wherein each of the chambers is a curve tube, and the curve tube has a specific curve angle.

4. The earphone structure of claim 3, wherein the curve angle of at least one of the curve tubes is within a range of 80 degrees to 100 degrees.

5. The earphone structure of claim 3, wherein the each of the curve tube has an opening, and at least one pair of the openings are opposite to each other.

6. The earphone structure of claim 3, wherein one curve tube among the curve tubes has an opening facing to an internal side of the composite chamber, and the other curve tube among the curve tubes has an opening facing to an external side of the composite chamber and is close to the cover.

7. The earphone structure of claim 2, wherein the chamber is a grid plate, and the grid plate has a specific curve angle.

8. The earphone structure of claim 7, wherein the curve angle of at least one of the grid plates is within a range of 80 degrees to 100 degrees.

9. The earphone structure of claim 2, wherein the chamber extends toward to a direction opposite to the composite chamber.

10. The earphone structure of claim 1, wherein the case and the cover jointly cover the composite chamber for forming the earphone structure, and the composite chamber receives a plurality of sound source signals and forms a composite room, such that a composite sound field is formed by the sound source signals.

11. The earphone structure of claim 10, wherein the sound source signals at least comprise a first sound source signal and a second sound source signal, which are originated at opposite sides of the composite chamber, respectively.

12. The earphone structure of claim 11, wherein a location where the first sound source signal is originated at and a location where the second sound source signal is originated at on the opposite sides of the composite chamber are not symmetrical.

13. The earphone structure of claim 11, wherein the sound source signals further comprise at least a subwoofer sound source signal.

14. The earphone structure of claim 13, wherein the subwoofer sound source signal is originated at a back side of the composite chamber.

15. The earphone structure of claim 10, wherein the sound source signals are the signals which have been processed by a sound field simulation process for generating a simulation sound field in the composite chamber.

16. The earphone structure of claim 15, wherein the sound field simulation process is designed based on a frequency-divided point of the sound source signals.

17. The earphone structure of claim 15, wherein the sound field simulation process is designed based on a frequency-divided point of the sound source signals and a delay process.

18. The earphone structure of claim 1, wherein the subspeakers comprise a first channel speaker and a second channel speaker, which are disposed on two opposite sides of the composite chamber.

19. The earphone structure of claim 18, wherein a position where the first channel speaker is disposed at and a position where the second channel speaker is disposed at are not symmetrical.

20. The earphone structure of claim 19, wherein the subspeakers further comprises a subwoofer speaker.

21. The earphone structure of claim 20, wherein the subwoofer speaker is disposed on a back side of the composite chamber.

22. The earphone structure of claim 1, wherein the composite chamber is a hollow column.

* * * * *